US011753871B2

(12) United States Patent
Zhang et al.

(10) Patent No.: US 11,753,871 B2
(45) Date of Patent: Sep. 12, 2023

(54) ROTARY STEERABLE SYSTEM FOR WELLBORE DRILLING

(71) Applicant: Halliburton Energy Services, Inc., Houston, TX (US)

(72) Inventors: Lizheng Zhang, Humble, TX (US); Wei Zhang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/542,030

(22) Filed: Dec. 3, 2021

(65) Prior Publication Data

US 2022/0268102 A1 Aug. 25, 2022

Related U.S. Application Data

(60) Provisional application No. 63/153,113, filed on Feb. 24, 2021.

(51) Int. Cl.
*E21B 7/06* (2006.01)

(52) U.S. Cl.
CPC ..... *E21B 7/064* (2013.01); *E21B 7/068* (2013.01); *E21B 7/061* (2013.01)

(58) Field of Classification Search
CPC . E21B 7/06; E21B 7/064; E21B 7/068; E21B 7/061
See application file for complete search history.

(56) References Cited

U.S. PATENT DOCUMENTS 5,971,085 A * 10/1999 Colebrook ..... E21B 7/06 175/266
8,157,024 B2 4/2012 de Paula Neves et al.
8,302,703 B2 * 11/2012 Rolovic ..... E21B 7/065 175/408
8,474,552 B2 7/2013 de Paula Neves et al.
9,869,140 B2 * 1/2018 Rushton ..... E21B 17/1014
2006/0157283 A1 * 7/2006 Hart ..... E21B 17/1014 175/76
2008/0000693 A1 1/2008 Hutton
2014/0124306 A1 * 5/2014 Chelaidite ..... F16D 65/0977 188/240
2015/0322779 A1 11/2015 Logan et al.
2016/0017998 A1 1/2016 Orban et al.
2016/0069139 A1 3/2016 Sugiura et al.
(Continued)

FOREIGN PATENT DOCUMENTS

WO 2019245539 A1 12/2019

OTHER PUBLICATIONS

PCT/US2021/061972, "International Search Report and Written Opinion", dated Mar. 18, 2022, 11 pages.
(Continued)

*Primary Examiner* — Taras P Bemko
(74) *Attorney, Agent, or Firm* — Kilpatrick Townsend & Stockton LLP

(57) ABSTRACT

A system can be used for drilling a wellbore. The system can include a steering collar, an actuation cylinder, and a radial seal. The steering collar can be positioned on a drilling tool for forming a wellbore. The actuation cylinder can be positioned on the drilling tool for abutting a steering pad for actuating the steering pad. The radial seal can be positioned on the drilling tool between the steering collar and the actuation cylinder.

20 Claims, 18 Drawing Sheets

(56) References Cited

U.S. PATENT DOCUMENTS

| | | | | |
|---|---|---|---|---|
| 2016/0326805 | A1 | 11/2016 | Gao | |
| 2019/0128071 | A1 | 5/2019 | Conger et al. | |
| 2020/0263501 | A1* | 8/2020 | Doud | F16J 15/28 |
| 2020/0318436 | A1 | 10/2020 | Doud et al. | |
| 2020/0332597 | A1* | 10/2020 | Doud | E21B 7/067 |
| 2020/0332599 | A1* | 10/2020 | Doud | E21B 7/06 |
| 2020/0392790 | A1* | 12/2020 | Perry | E21B 7/06 |
| 2021/0087885 | A1 | 3/2021 | Chambers et al. | |

OTHER PUBLICATIONS

Halliburton, iCruise Intelligent Rotary Steerable System, 2019, 1 page.

* cited by examiner

ROTARY STEERABLE SYSTEM FOR WELLBORE DRILLING

CROSS-REFERENCE TO RELATED APPLICATION

This claims priority to U.S. Provisional Application Ser. No. 63/153,113, filed Feb. 24, 2021 and titled "Rotary Steerable System for Wellbore Drilling," the contents of which are incorporated herein by reference.

TECHNICAL FIELD

The present disclosure relates generally to wellbore operations and, more particularly (although not necessarily exclusively), to a rotary steerable drilling system usable to form a wellbore.

BACKGROUND

A wellbore can be formed in a subterranean formation for extracting produced hydrocarbon material or other suitable material. The wellbore may experience or otherwise encounter one or more wellbore operations such as drilling the wellbore. Drilling, or otherwise forming, the wellbore can involve using a drilling system that can include a drill bit and other suitable tools or components for forming the wellbore. During drilling, the drilling system may change the course (e.g., speed, direction, etc.) of the drill bit to form a wellbore that may not be purely vertical. Other drilling systems may incur damage or may include elastomeric seals that can wear out, and need replacing, quickly. Additionally, the other drilling systems may include seals that obstruct functionality of the other drilling systems.

DETAILED DESCRIPTION

Figure 1:
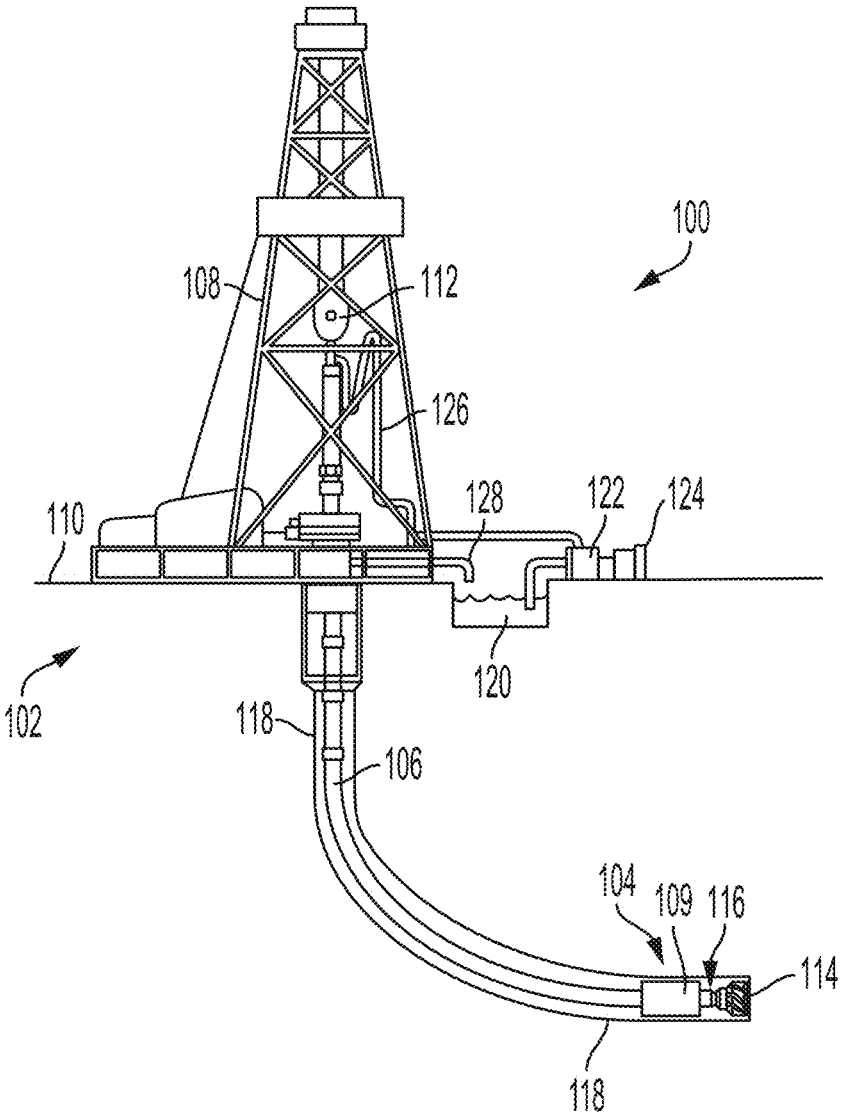
FIG. 1 is a schematic of a well system that can use a rotary steerable system to form a wellbore according to one example of the present disclosure.

Certain aspects and features of the present disclosure relate to a rotary steerable system that includes a drilling tool with a radial seal positioned between a steering collar and an actuation cylinder. The drilling tool may include a pad actuator or other suitable tool for drilling into a subterranean formation to form a wellbore for extracting produced hydrocarbons. In some examples, the tool can drill directionally with continuous rotation from the surface of the subterranean formation. The steering collar can be a frame of the drilling tool and may stiffen the drilling tool to allow the drilling tool to exert force on a borehole for changing a direction of drilling while forming the wellbore. The actuation cylinder can actuate or otherwise open in response to receiving pressurized mud. By actuating, the actuation cylinder can use pistons to actuate or otherwise engage a steering pad that, when engaged, exerts force on the borehole to change the direction of drilling of the drilling tool. The radial seal can be positioned between the steering collar and the actuation cylinder to allow the pistons to actuate or otherwise move without obstruction along the actuation cylinder to allow the direction of drilling of the drilling tool to be changed. Additionally, using the radial seal in the drilling tool may reduce a frequency or severity of high-frequency torsional oscillation, which can cause the steering collar to sustain cracks or other damage, compared to using other seals.

Rotary steerable systems can include face seals positioned between the steering collar and the actuation cylinder, but the face seals can encounter failures. The failures can cause certain problems, such as loss of the ability to steer the rotary steerable system, trip out-of-hole issues, erosion, and cracking or other damage to the steering collar. The face seals can be replaced with at least one radial seal by changing relationships among components within the rotary steerable system. Examples of such components include the steering collar, the actuation cylinder, the pistons, and the like. In some examples, the radial seal can be included in a rotary steerable system that includes the face seals. Additionally, the rotary steerable system can include at least one pad actuation visual indicator that can be used for setting up the tool of the rotary steerable system, calibrating the rotary steerable system, testing the system, and the like.

The actuation cylinder can be centered or otherwise located proximate to the steering collar using the radial seal. Clearances between a piston hanger and a steering pad, which can be positioned between the actuation cylinder and pad housing, may allow obstruction-free movement of the piston along the actuation cylinder. Torsional stiffness of a pad pocket area can be increased by using the radial seal, and an increased torsional stiffness may reduce the frequency or severity of high-frequency torsional oscillation (HFTO). HFTO can cause the steering collar to crack or otherwise sustain damage.

Additionally, at least one orifice can be added to the piston, to the actuation cylinder, to the steering collar, or a combination thereof to indicate an actuation state of each steering pad. A jet of mud ejected from the orifice can indicate that the associated pad is energized. A port to accommodate the orifice on the steering collar can additionally or alternatively be used evaluate performance, such as pad pressure and pad force, of the radial seal without disassembling the tool of the rotary steerable system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system that can use a rotary steerable system to form a wellbore according to one example of the present disclosure. The well system 100 can include a wellbore 118 that can be used to extract hydrocarbons from a subterranean formation 102. The wellbore 118 can be drilled or otherwise formed using the well system 100. For example, the well system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 used to lower and raise the drill-string 106.

The BHA 104 may include a drill bit 114, a rotary steerable system 109, other suitable components, or a combination thereof. The drill bit 114 can be operatively coupled to a tool string 116, and the drill bit 114 may be moved axially within a drilled wellbore 118 and can be attached to the drill-string 106. During operation, the drill bit 114 can penetrate the subterranean formation 102 to create the wellbore 118. The BHA 104 can control the drill bit 114 as the drill bit 114 advances into the subterranean formation 102. For example, the rotary steerable system 109 can control a direction of drilling by applying a steering pressure or other suitable force to a wall of the wellbore 118.

Fluid or "mud" from a mud tank 120 may be pumped downhole using a mud pump 122 that can be powered by an adjacent power source, such as a prime mover or motor 124. The mud may be pumped from the mud tank 120, through a stand pipe 126, which can feed the mud into the drill-string 106, the rotary steerable system 109, or other suitable components of the well system 100 and can convey the mud to the drill bit 114. The mud can exit one or more nozzles (not shown) arranged in the drill bit 114 and can thereby cool the drill bit 114. Additionally or alternatively, the mud can be directed (e.g., as pressurized mud) into the rotary steerable system 109 for adjusting a direction of the drill bit 114. After exiting the drill bit 114 or other suitable component, the mud can circulate back to the surface 110 via the annulus defined between the wellbore 118 and the drill-string 106. Cuttings and mud mixture that can be passed through a flow line 128 can be processed such that a cleaned mud is returned down hole through the stand pipe 126.

The rotary steerable system 109 can include a steering collar, an actuation cylinder, and a radial seal. The steering collar can provide a rigid frame for the rotary steerable system 109, and the actuation cylinder can include a piston that can be used to apply the steering pressure or other suitable forces. The radial seal can be positioned between the steering collar and the actuation cylinder for forming a pressure seal or other suitable type of seal in the rotary steerable system 109. For example, the radial seal can allow the rotary steerable system 109 to receive pressure (e.g., via pressurized mud, etc.) that can be used to apply the steering force without incurring damage, obstruction, excessive wear, or other related undesirable effects from the pressure. The rotary steerable system 109 can include other suitable components.

Figure 2:
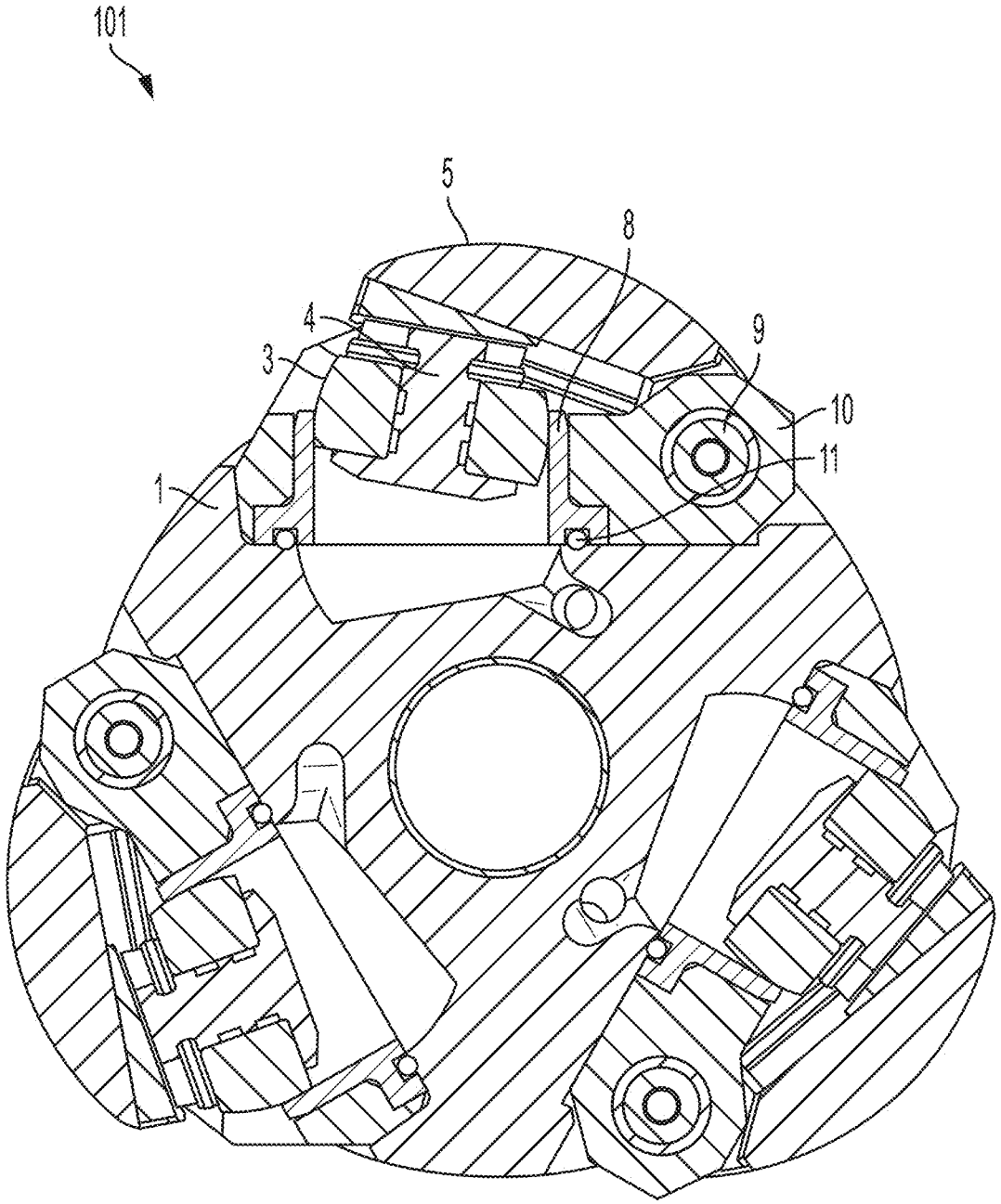
FIG. 2 is a sectional top-view of an example of a rotary steerable system pad actuator according to one example of the present disclosure.

FIG. 2 is a sectional top-view of an example of a rotary steerable system pad actuator 101 according to one example of the present disclosure. The pad actuator 101 can include a steering collar 1 and an actuation cylinder 8. The steering collar 1 can be a rigid frame of the rotary steerable system pad actuator 101 or other suitable component of a rotary steerable drilling system. The actuation cylinder 8 can be positioned abutting a steering pad 5 or in other suitable positions with respect to the pad actuator 101.

The pad actuator 101 can additionally include a face seal 11 that can be positioned between the steering collar 1 and the actuation cylinder 8. The face seal 11 can provide a seal for the actuation cylinder 8 for allowing a piston 3 or the actuation cylinder 8 to receive pressure (e.g., via pressurized mud or gas, etc.) to actuate during a drilling operation. The pad actuator 101 may additionally include the piston 3 that can be mechanically coupled to, positioned within, or otherwise suitably positioned with respect to the actuation cylinder 8. A seal between the piston 3 and the actuation cylinder 8 can be a metal-to-metal seal that can prevent fluid leaks. For example, the seal between the piston 3 and the actuation cylinder 8 can contain or retain pressurized mud from upstream of the steering collar 1. The pressure from the mud can act on the piston 3, and the piston 3 can exert a force against a pad 5. The pad 5 can pivot on a pad housing 10 (e.g., via hinge pin 9) and can exert a force against the borehole being drilled. In some examples, the pad 5 can be positioned adjacent to or otherwise proximate to the drill bit 114.

The force against the borehole can be a steering force that can change the direction of drilling performed by the pad actuator 101. The face seal 11 may allow extrusion failure in which pad pressure or the steering force is lost. In examples in which extrusion failure affects the pad actuator 101, erosion and cracking of the steering collar 1 or other parts can occur. The face seal 11 may rely on a contact pressure between the pad housing 10 and the steering collar 1, which can be held together by bolts with pretension. Vibration during drilling can cause the bolts to loosen and, subsequently, can cause a loss of contact pressure between the pad housing 10 and the steering collar 1. The face seal 11, or the pad actuator 101, can leak in these examples.

Figure 3:
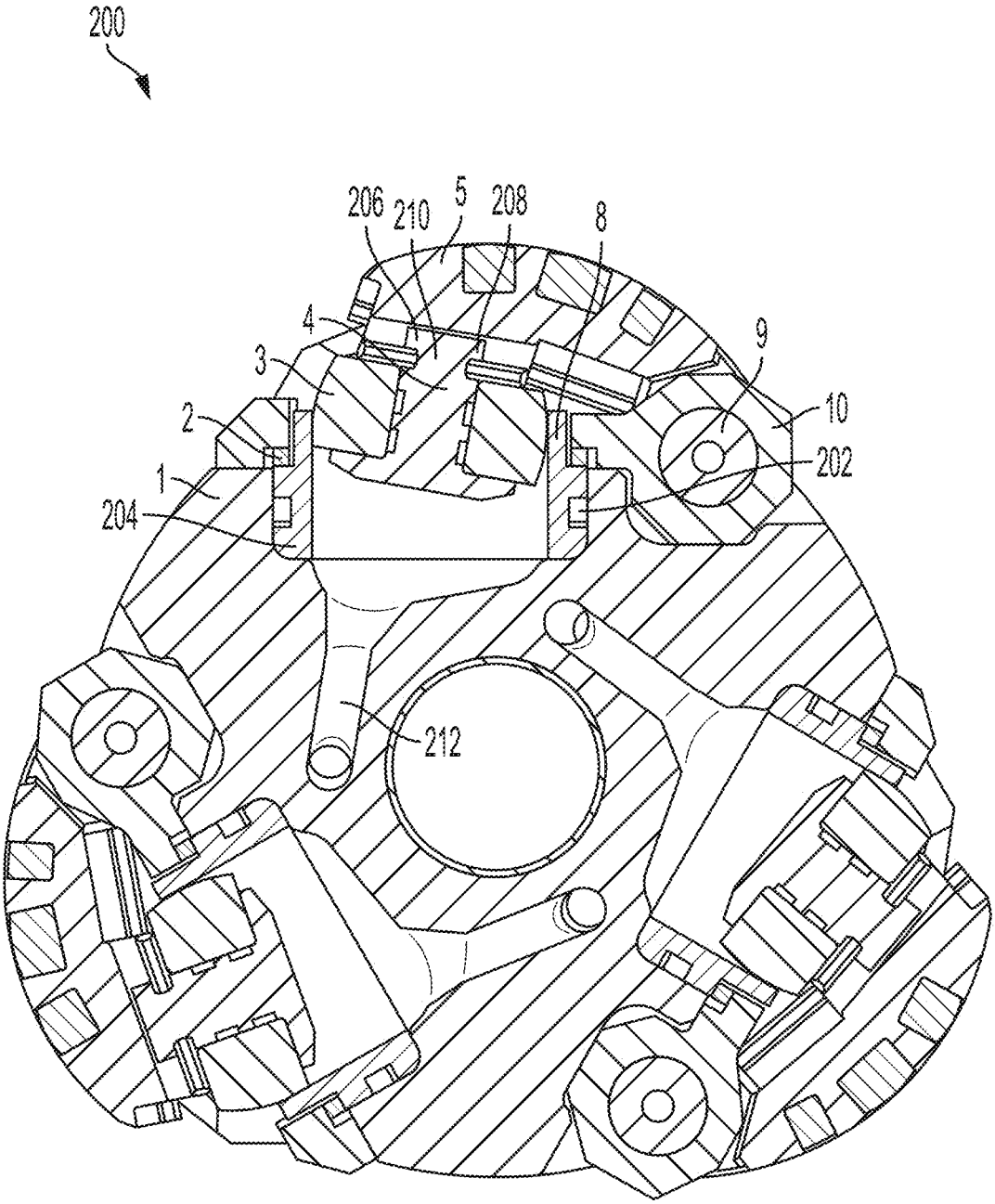
FIG. 3 is a sectional top-view of an example of a rotary steerable system pad actuator that includes a radial seal according to one example of the present disclosure.

FIG. 3 is a sectional top-view of an example of a rotary steerable system pad actuator 200 that includes a radial seal 202 according to one example of the present disclosure. In some examples, the radial seal 202 can replace the face seal 11. In other examples, the radial seal 202 can be used in addition to the face seal 11. Using a combination that includes the radial seal 202 and the face seal 11 can improve a performance (e.g., durability, torsional oscillation reduction, or other performance indicators) of the pad actuator 200 compared with a pad actuator that does not use the combination. The radial seal 202 may not rely on contact pressure between the pad housing 10 and the steering collar 1. The radial seal 202 may allow for some reciprocating motion between the actuation cylinder 8 and the steering collar 1 without failures such as the extrusion failure or other related failures.

The actuation cylinder 8 may be positioned within a pocket 204 provided by the steering collar 1 and can be retained by the pad housing 10 and a spacer 2 between the pad housing 10 and the actuation cylinder 8. In some examples, lateral clearances can exist among the steering collar 1, the actuation cylinder 8, the pocket 204, and the pad housing 10 such that lateral loads applied to the pad housing 10 during drilling may not transfer to the actuation cylinder 8.

Similar to the pad actuator 101, the pad actuator 200 may include a piston 3 and an actuation cylinder 8. The piston 3 may not be cylindrical and may instead include a semi-spherical or otherwise rounded shape. The piston may be capable of experiencing a rolling or rotational motion while the rotary steerable system 109 is drilling or in other suitable situations. The actuation cylinder 8 may include a cylindrical shape (e.g., with straight, non-curved walls) and may be sized to receive the piston 3. The pad actuator 200 may allow a seal between the piston 3 and the actuation cylinder 8 for sealing or preventing leaks in the pad actuator 200. The seal may include the metal-to-metal seal, for example, as described with respect to FIG. 1. The actuation cylinder 8 may open or otherwise actuate to allow the piston 3 to move with respect to the actuation cylinder 8. For example, the pad actuator 200 can receive pressure (e.g., pressurized mud upstream from the pad actuator 200) and can direct the pressure (e.g., through line 212) to the actuation cylinder 8. In some examples, the pressure can include or otherwise be a differential pressure that can cause the steering pad 5 to actuate or otherwise displace outward. The pressure can cause the actuation cylinder 8, for example, to open and to allow the piston 3 to move or otherwise displace. Motion of the piston 3 may be rotational, may not be a straight-line displacement, or may otherwise include a rolling-like motion. For example, moving from a bottom of the actuation cylinder 8 to a top of the actuation cylinder 8, the piston 3 may rotate about a single point and may follow an arc-length path while displacing. The piston 3 can experience other suitable types of motion with respect to the actuation cylinder 8.

The piston 3 can receive pressure (e.g., pressurized mud, etc.) from the surface or otherwise upstream from the pad actuator 200. The pressure received by the piston 3 can be transferred to the pad 5 and may cause the pad 5 to exert a force against the borehole being formed by the drilling operation. In some examples, an area of the piston 3 contacting the pad 5 may correspond to a steering force applied by the pad 5. For example, a larger or smaller area of the piston 3 may correspond, respectively, to a larger or smaller steering force applied by the pad 5. The force against the borehole can be a reaction force that can steer a bottom-hole assembly for changing the direction of drilling performed by the pad actuator 200.

The pad 5 can additionally include a T-slot 206 that can be sized to receive at least a portion of the piston 3, a piston hanger 4, or other suitable component of the pad actuator 200. For example, the piston hanger 4 can include a grooved region 210 that can be positioned in or otherwise proximate or adjacent to the T-slot 206. In some examples, the T-slot 206 can be detachable, for example, for allowing quick replacement of portions of the pad 5 that may quickly wear during operation. Clearance between a T-slot 206 on the pad 5 and a head 208 of the piston hanger 4 can exist such that interference due to part tolerances and external loads does not occur.

Figure 4:
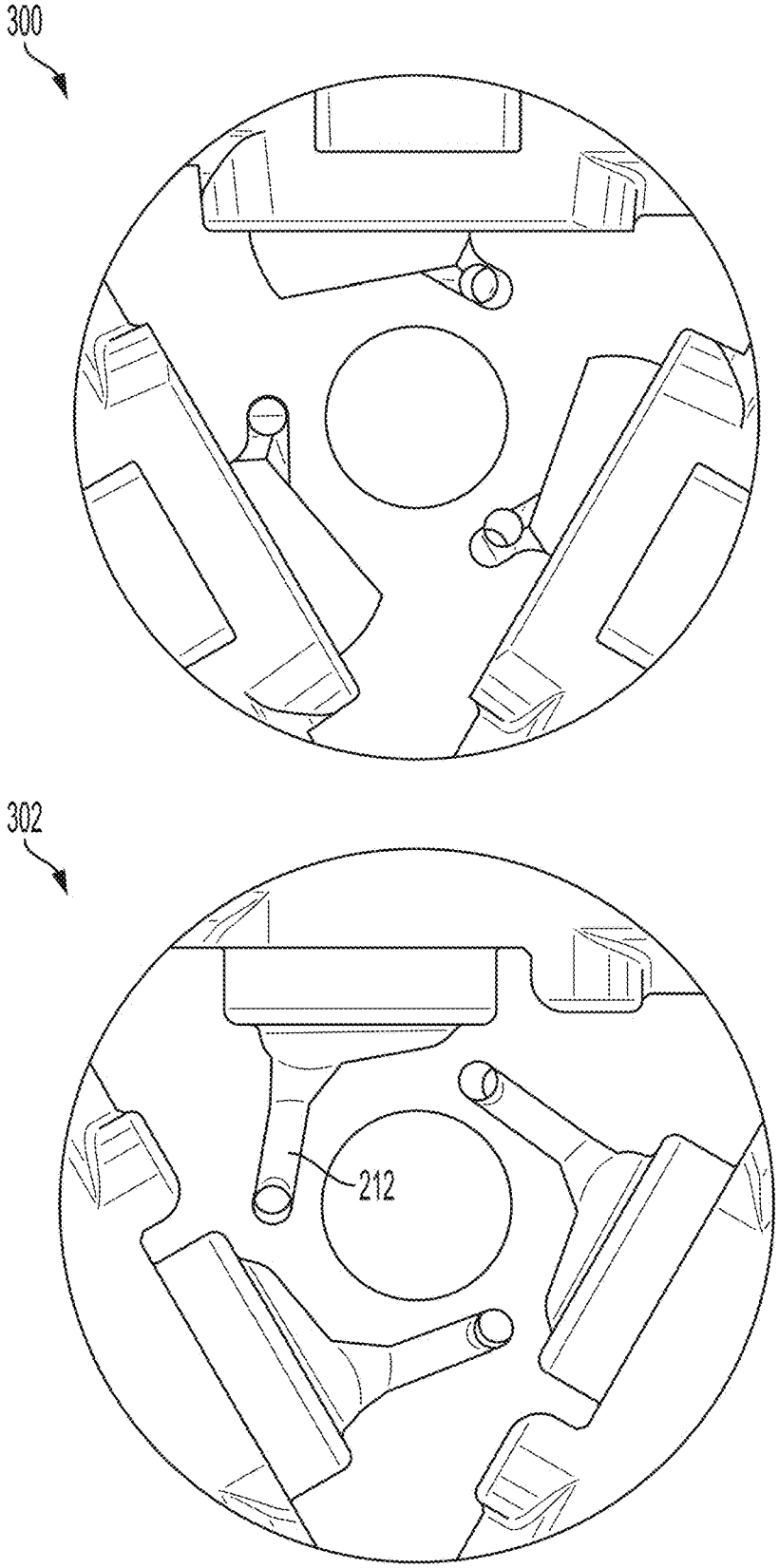
FIG. 4 is a set of zoomed-in sectional views of a center of a pad actuator and a center of a pad actuator according to one example of the present disclosure.

FIG. 4 is a set of zoomed-in sectional views of a center 300 of the pad actuator 101 and a center 302 of the pad actuator 200 according to one example of the present disclosure. The pocket on the steering collar 1, which can include the actuation cylinders 8, can increase an area moment of inertia of the center 302. For example, the center 300 that includes the face seal 11 can be defined by an area moment of inertia of 20.3 $in^4$, or 844.95 $cm^4$. In this example, the center 302 that includes the radial seal 202 can be defined by an area moment of inertia of 23 $in^4$, or 957.33 $cm^4$. The center 302 can span a majority of the length of the pad pocket 204, which can increase torsional stiffness of the center 302 compared to the center 300. In some examples, the center 302 may have a reduced likelihood and severity of high frequency torsional vibration (HFTO) compared to the center 300. HFTO can cause cracking of the center of a pad actuator. Mud port inlets (e.g., the lines 212) can be positioned on the pad actuator 200 that can yield less stress from rotational motion, bending motion, and torsional oscillation compared to mud port inlets positioned on the pad actuator 101 or on pad actuators using elastomeric seals. During assembly, lab testing, and rig-site testing of the pad actuator 200, a visual indicator a jet path, of pad actuation can be used to ensure a correct tool face is used.

Figure 5:
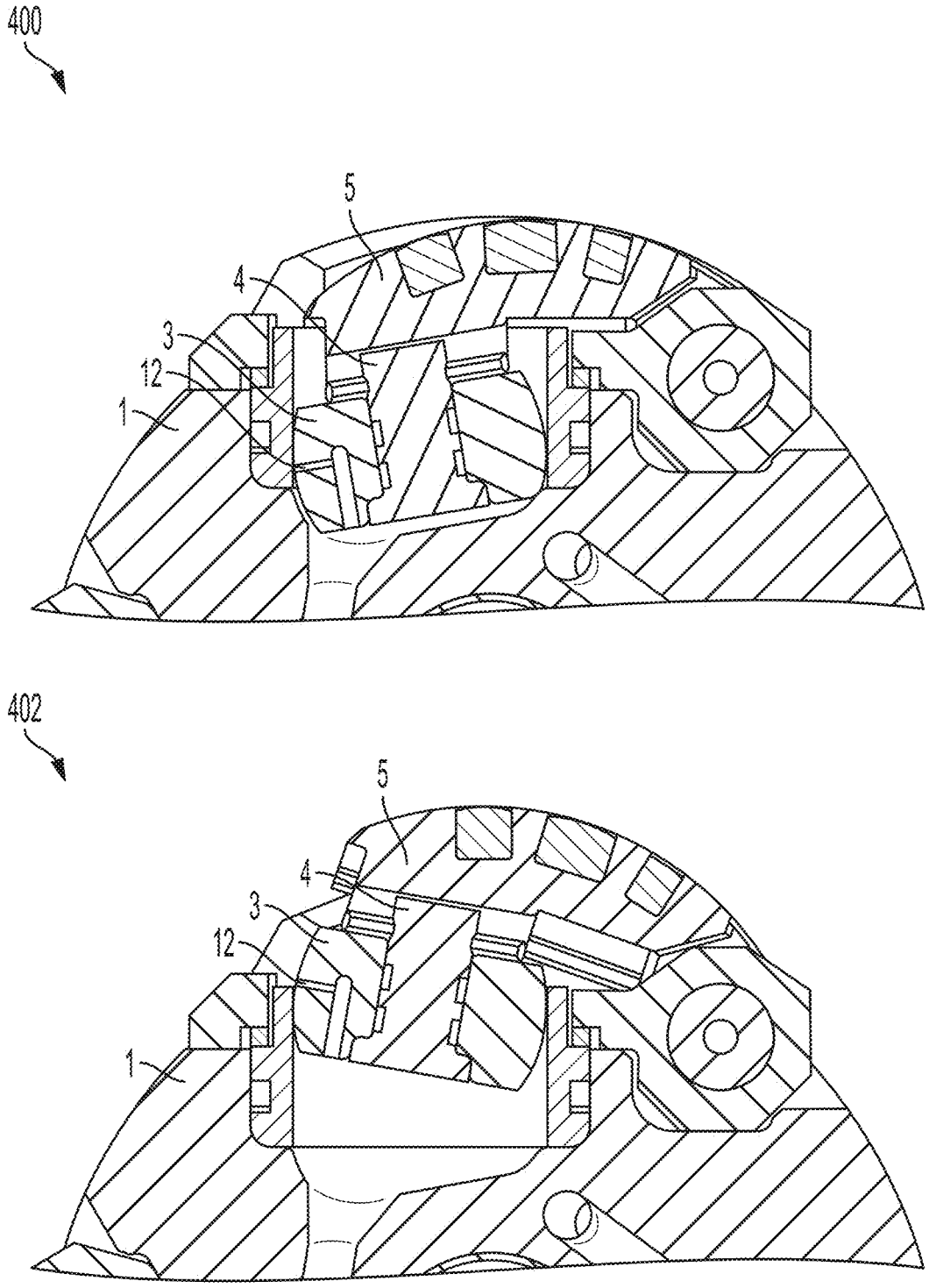
FIG. 5 is a diagram of an orifice that is positioned on a piston of an actuation cylinder according to one example of the present disclosure.

FIG. 5 is a diagram of an orifice 12 that is positioned on the piston 3 of the actuation cylinder 8 according to one example of the present disclosure. The orifice 12 can be positioned in other suitable locations with respect to the pad actuator 200. In an example in which the actuation cylinder 8 is not actuated or is otherwise opened to a diameter similar to that of typical drilling-hole over-gauge, a flow path through the orifice 12 can be obstructed such that no (or essentially zero) pressure, mud, or other suitable material may flow out of the orifice. In examples in which the actuation cylinder 8 is actuated or is otherwise fully open, the piston 3 may be displaced or rotated to allow pressurized mud to pass through the orifice 12 and form a mud jet on a low pressure side of the piston 3. The mud jet can be a visual indicator of the actuation of the actuation cylinder 8 or the piston 3, and, in some examples, the mud jet can be viewable by an operator of the drilling operation. The mud jet can additionally remove at least some debris accumulated on a side opposite the low pressure side of the piston 3. The piston 3 may include erosion-resistant material, and, as such, the orifice 12 may not substantially erode due to high velocities of mud from the mud jet.

FIG. 5 additionally illustrates a retracted configuration 400 of the pad 5 and an actuated configuration 402 of the pad 5. The retracted configuration 400 can involve the piston 3 positioned, for example, wholly or mostly within the actuation cylinder 8, and the actuated configuration 402 can involve the piston 3 rotated or displaced out of the actuation cylinder 8. By being displaced out of the actuation cylinder 8, the piston 3 may apply pressure (e.g., received from pressurized mud upstream from the pad actuator 200, etc.) or other suitable force on the pad 5. The pad 5 can receive the pressure or other suitable force and can rotate (e.g., via the hinge pin 9) outward. The actuated configuration 402 may be used to apply (e.g., via the pad 5) pressure or force on a wall of a subterranean formation for altering a direction of drilling while forming a wellbore.

Figure 6:
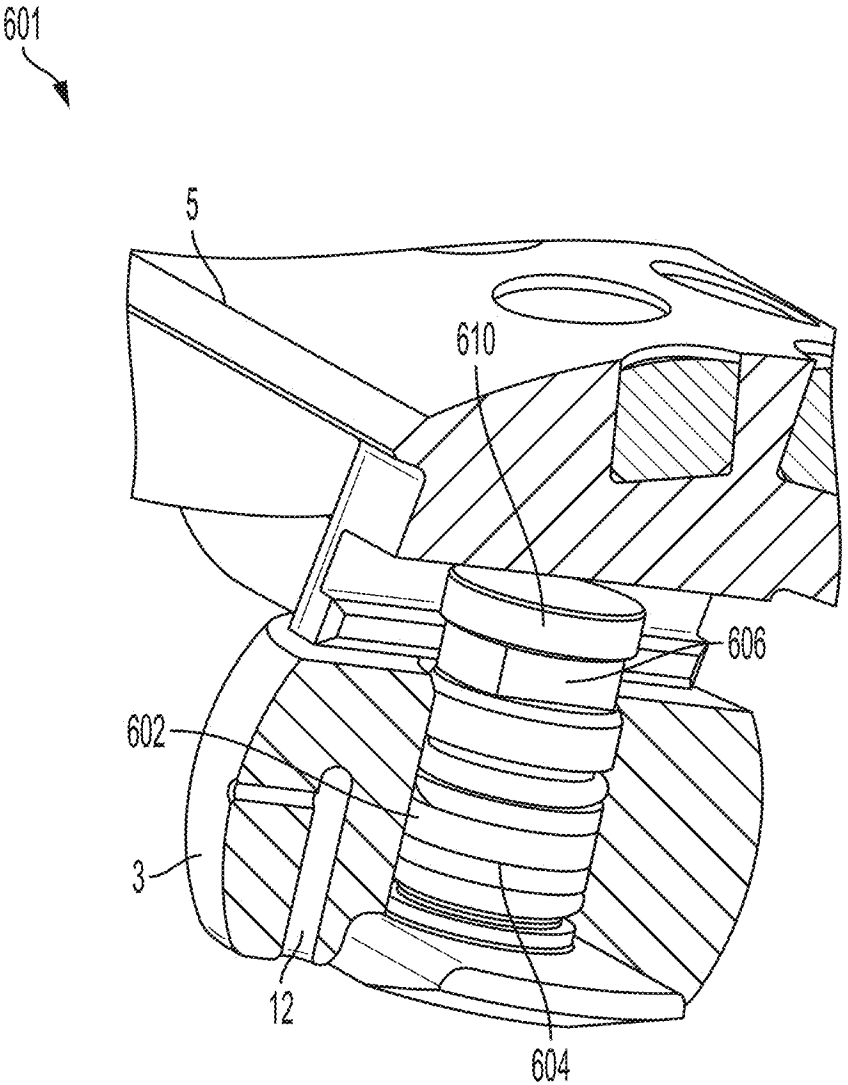
FIG. 6 is a diagram of a piston that includes an orifice according to one example of the present disclosure.
Figure 6:
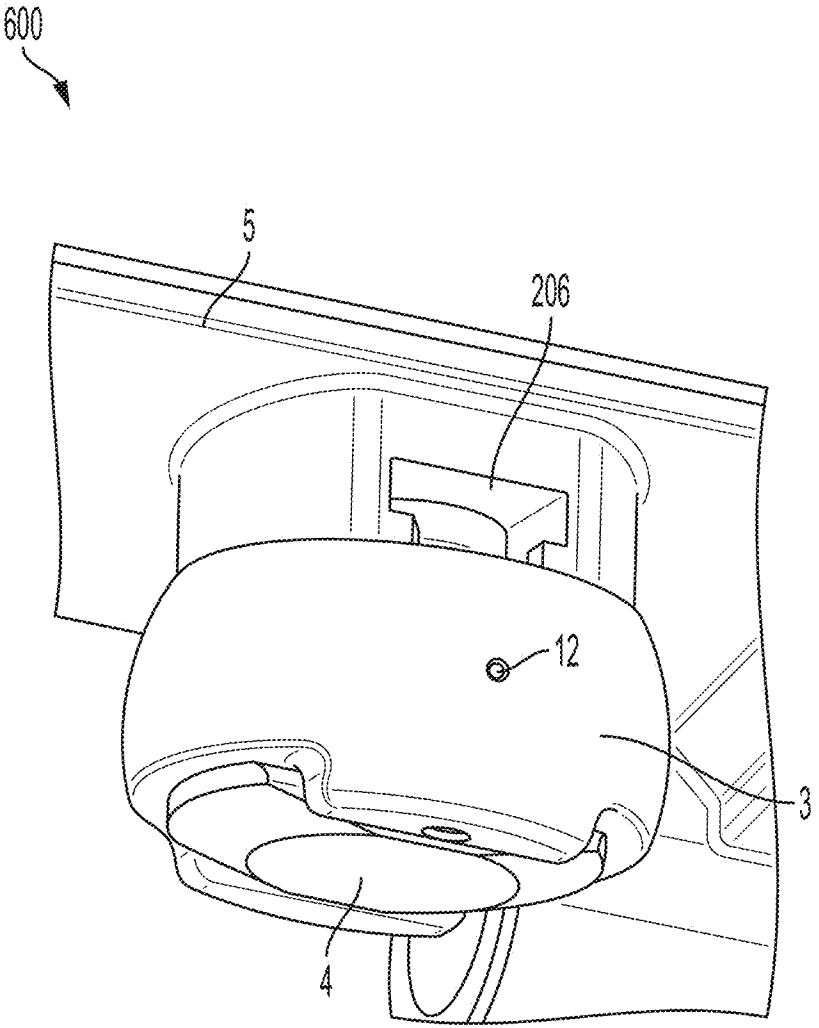

FIG. 6 is a diagram of a piston 3 that includes an orifice 12 according to one example of the present disclosure. To maintain a direction of the mud jet, the piston 3 can be mechanically coupled, or otherwise suitably coupled, to a piston hanger 4 by a key way 602 formed on the piston 3 and a key 604 formed on the piston hanger 4. The piston hanger 4 can be mechanically coupled to the pad actuator 200 through the T-slot 206 on the pad actuator 200 and a flat 606 (e.g., a grooved region) on a neck of the piston hanger 4, In an example in which more than one piston 3 is present on the pad actuator 200, the piston 3 with orifice can be positioned on the up-hole side (see FIG. 6), on the downhole side, or a combination thereof.

As illustrated in view 600 of FIG. 6, the T-slot 206 can be included in the pad 5. For example, the T-slot 206 can be positioned on a bottom surface (e.g., opposite a top surface that is positioned to contact a wall of the wellbore 118) of the pad 5. In some examples, the T-slot 206 can be formed integrally with the pad 5. In other examples, the T-slot 206 can be detachable (e.g., designed to be easily removed) to allow for replacement of the T-slot 206 or other suitable components of the pad 5 or the pad actuator 200 that may incur wear. The T-slot 206 can additionally be sized to receive at least a portion of the piston 3 or the piston hanger 4. For example, portion 610 of the piston hanger 4 in addition to a grooved region (e.g., the flat 606) of the piston hanger 4 can be positioned in the T-slot 206. Upon actuation of the actuation cylinder 8, the piston 3, the piston hanger 4, other suitable components, or a combination thereof, the portion 610 can transfer pressure or other suitable forces to the pad 5 via the T-slot 206 and can cause the pad 5 to displace outward for applying the steering force to the wall of the wellbore 118. The pad 5 and the T-slot 206 can include other suitable components.

Figure 7:
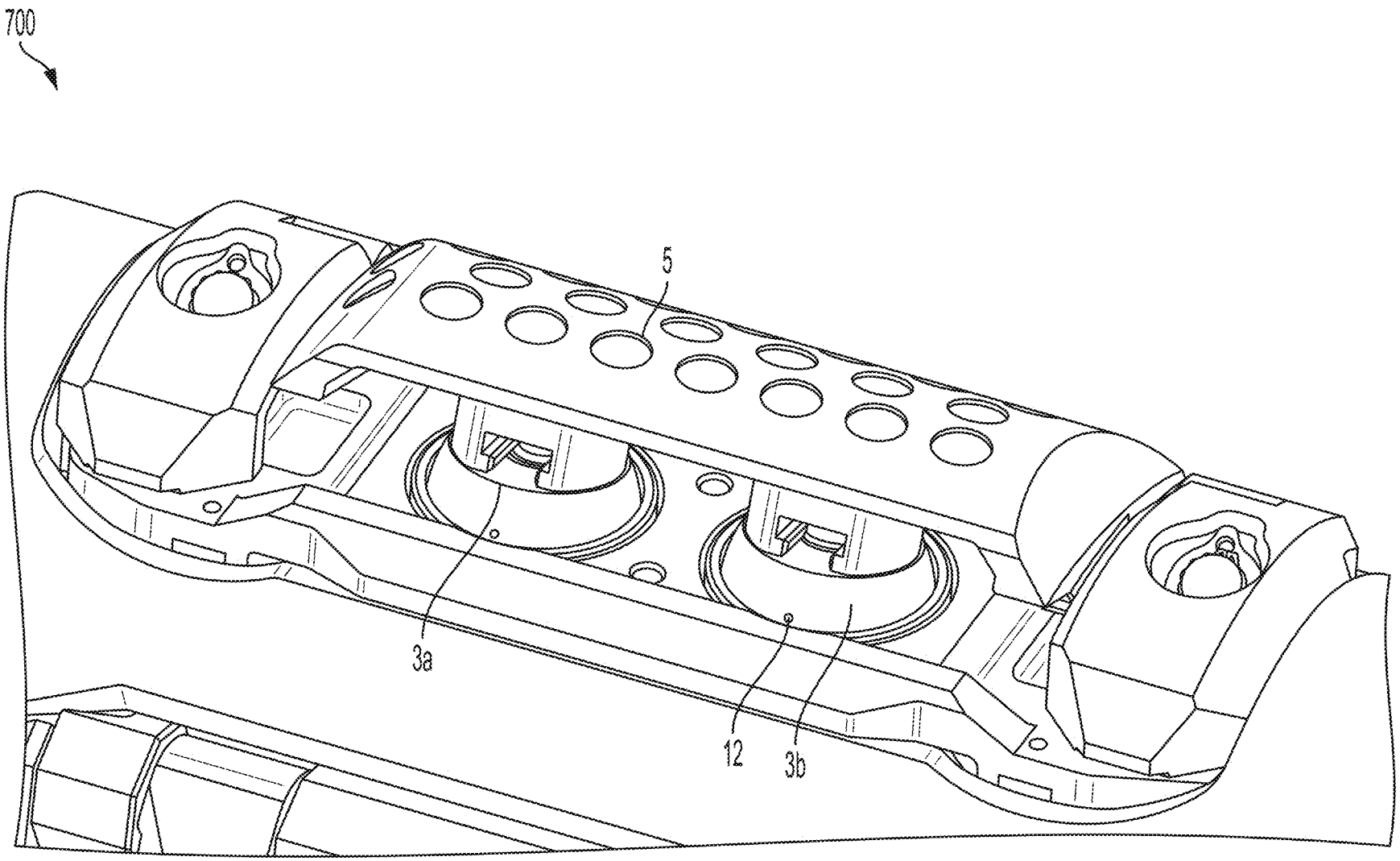
FIG. 7 is a perspective view of more than one piston positioned on a pad actuator according to one example of the present disclosure.

FIG. 7 is a perspective view of more than one piston 3 positioned on a pad actuator 700 (e.g., similar to the pad actuator 200) according to one example of the present disclosure. As illustrated in FIG. 7, the pad actuator 700 can include two pistons 3*a-b* and a pad 5. The pad actuator 700 can include other suitable amounts (e.g., one, two, three, four, and so on) of pistons 3 and pads 5. As illustrated, the piston 3*b* includes an orifice 12 and can be positioned on the downhole side of the pad actuator 700. In some examples, the piston 3 (or both or any combination of pistons 3) of the pad actuator 700 can include the orifice 12 and can be positioned in any suitable configuration with respect to the pad actuator 700.

Figure 8:
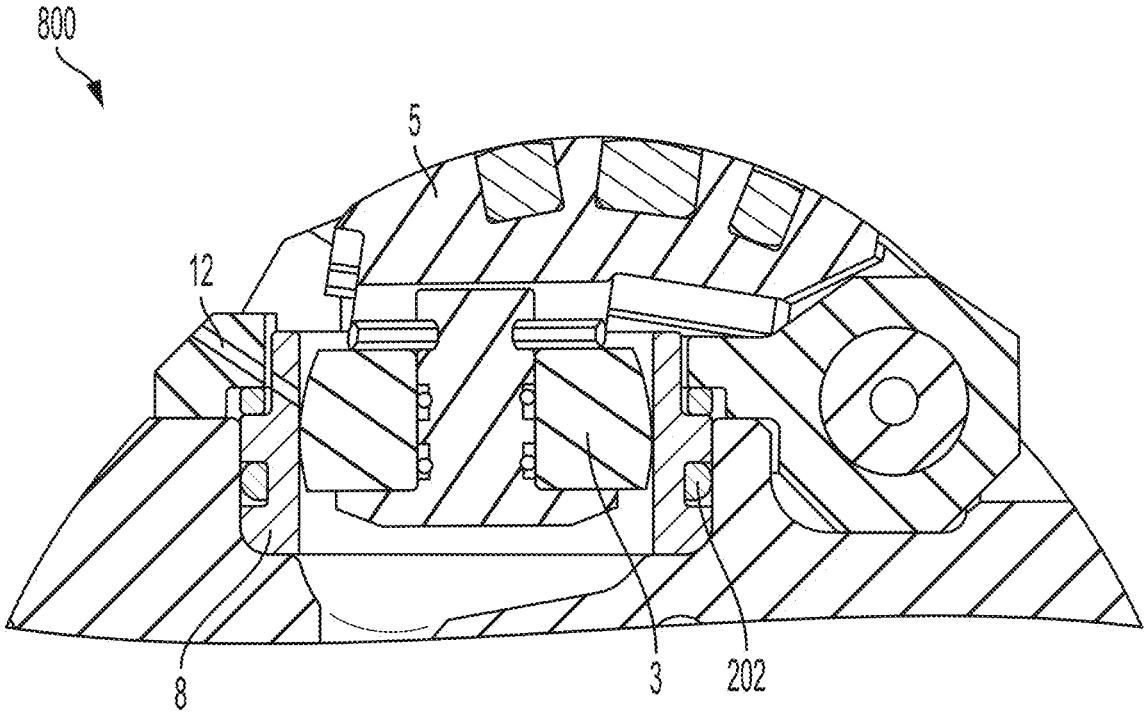
FIG. 8 is a sectional side-view of an orifice positioned on an actuation cylinder according to one example of the present disclosure.
Figure 8:
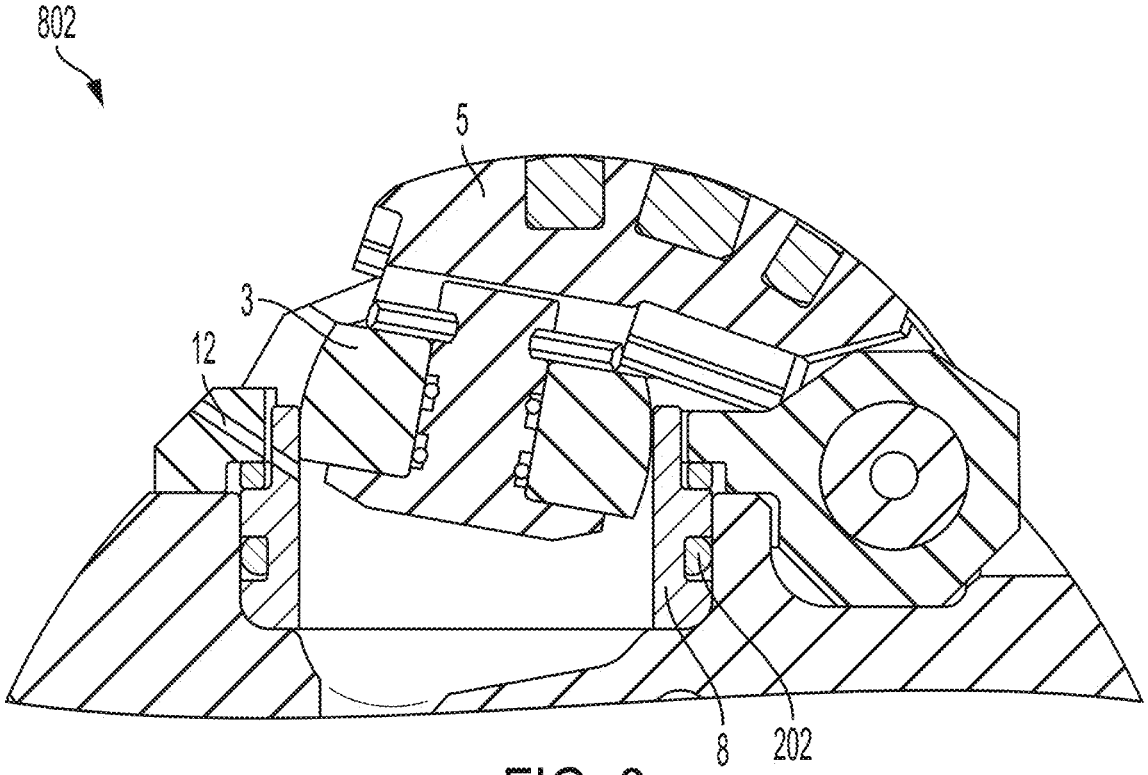

FIG. 8 is a sectional side-view of an orifice 12 positioned on an actuation cylinder 8 according to one example of the present disclosure. As illustrated, FIG. 8 includes a view of a retracted configuration 800 of the piston 3 and an actuated configuration 802 of the piston 3. The retracted configuration 800 can involve the pad 5 in a retracted state such that the pad 5 may not be contacting the wall of the wellbore 118. The actuated configuration 802 may involve the pad 5 actuated outward for applying the steering pressure or force to the wall of the wellbore 118. Pressurized mud (e.g., via the actuation cylinder 8, the piston 3, or a combination thereof) or other suitable source of pressure, may cause the pad 5 to actuate. The radial seal 202 may allow the actuation cylinder 8 to receive pressure, transmit pressure, or a combination thereof without causing damage or excessive wear to the pad actuator 200.

In an example, such as the retracted configuration 800, in which the piston 3 or the actuation cylinder 8 is not actuated, or is otherwise partially open, the mud can be obstructed by the piston 3 and may not reach the orifice 12 for forming the mud jet. In an example, such as the actuated configuration 802, in which the actuation cylinder 8 is actuated, for example in which the actuation cylinder 8 is in a testing position, the mud can escape the orifice 12 to form the mud jet. Additionally or alternatively, the orifice 12 can be positioned in a mud passage between upstream locations, such as a geostationary valve, and a mud inlet to the piston 3. The orifice 12 can be positioned in any other suitable location with respect to the actuation cylinder 8 and the piston 3.

Figure 9:
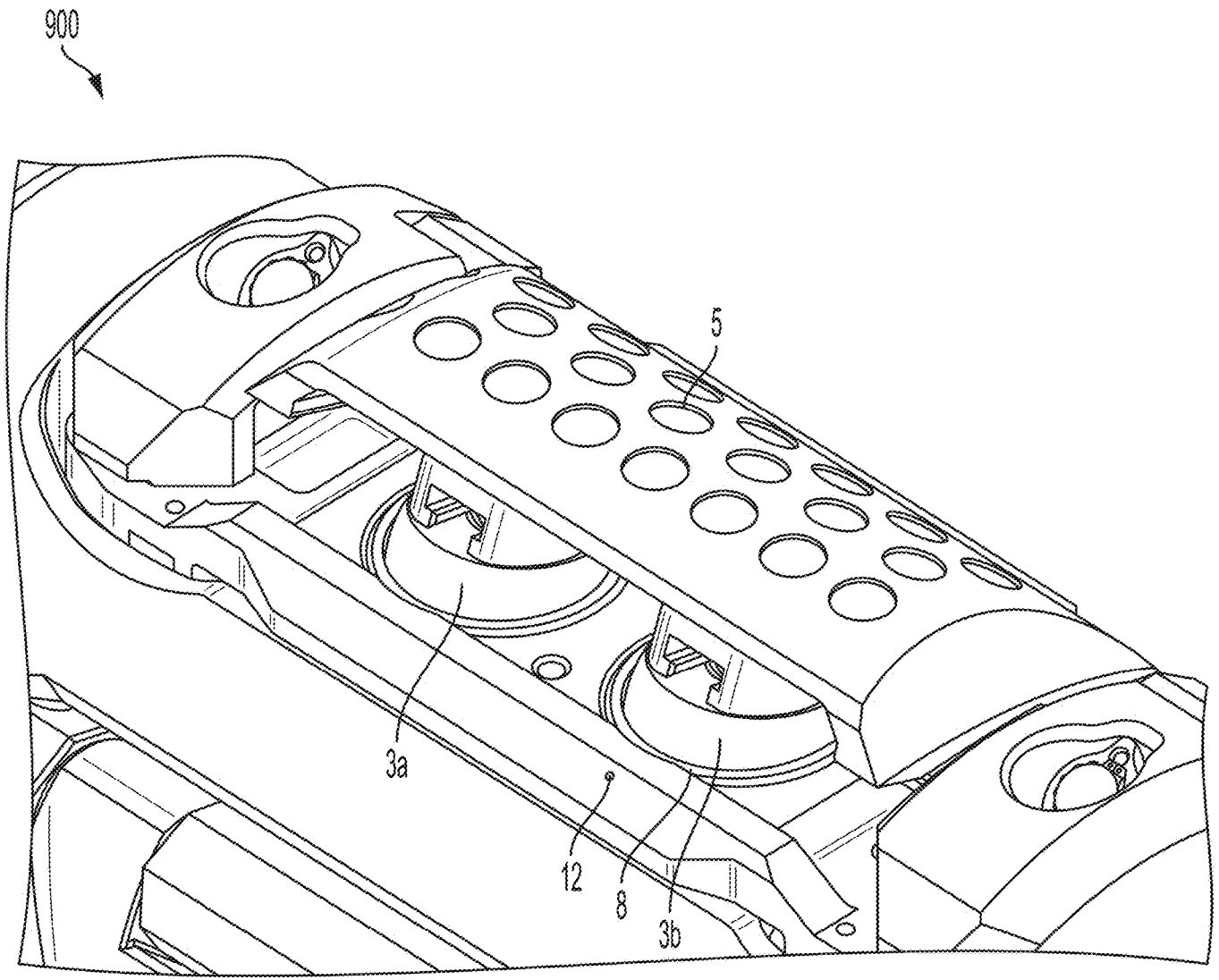
FIG. 9 is a perspective view of more than one piston positioned on a pad actuator according to one example of the present disclosure.

FIG. 9 is a perspective view of more than one piston 3 positioned on a pad actuator 900 according to one example of the present disclosure. As illustrated, the pad actuator 900 includes the pad 5 and the pistons 3*a-b*. The pad actuator 900 can include any other suitable amounts of pads 5 and pistons 3 for receiving pressure (e.g., pressurized mud) and for applying the steering pressure or force on the wall of the wellbore 118. Additionally, the pad actuator 900 can include an actuation cylinder 8 that can include an orifice 12. The orifice 12 can be positioned on the downhole side, but, in some examples, the orifice 12 can be positioned on the up-hole side or in any other suitable location with respect to the pad actuator 900.

Figure 10:
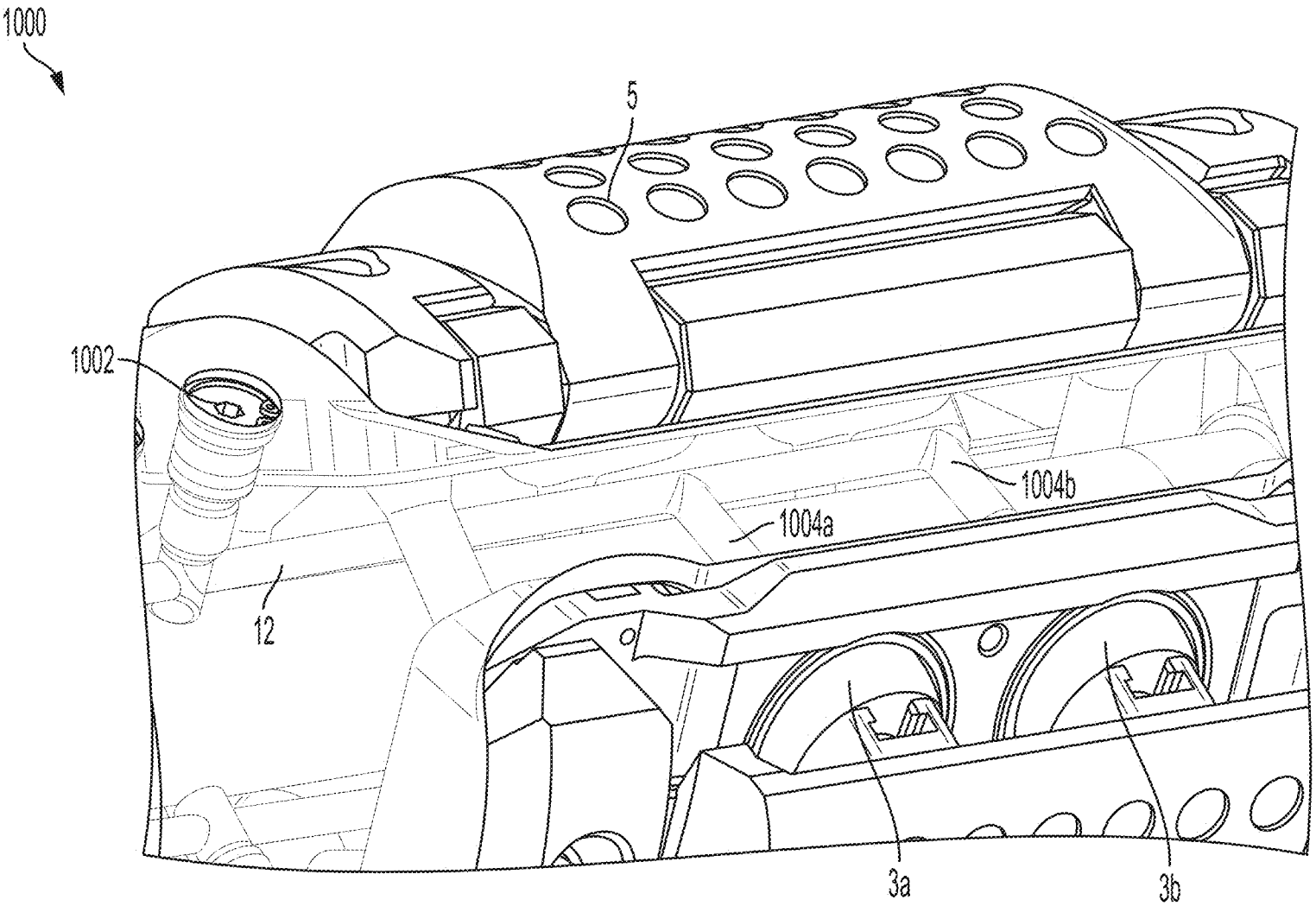
FIG. 10 is a perspective view of a pad actuator that includes an orifice holder according to one example of the present disclosure.

FIG. 10 is a perspective view of a pad actuator 1000 that includes an orifice holder 1002 according to one example of the present disclosure. The pad actuator 1000 can include the pad 5, the pistons 3*a-b*, and the orifice 12, which can be coupled to at least one of the pistons 3*a-b*. The pad actuator 1000 can include other suitable amounts of pads 5 and pistons 3*a-b*, and the orifice 12 can be positioned in any suitable location with respect to the pad actuator 101. Additionally, the orifice 12 can be coupled to any suitable component (e.g., the pistons 3, the actuation cylinder 8, etc.) of the pad actuator 1000. As illustrated, the orifice holder 1002 can be positioned upstream with respect to mud inlets 1004*a-b* of the pistons 3*a-b*. The orifice holder 1002 can be positioned in other suitable locations with respect to the mud inlets 1004*a-b* and the pad actuator 1000.

Figure 11:
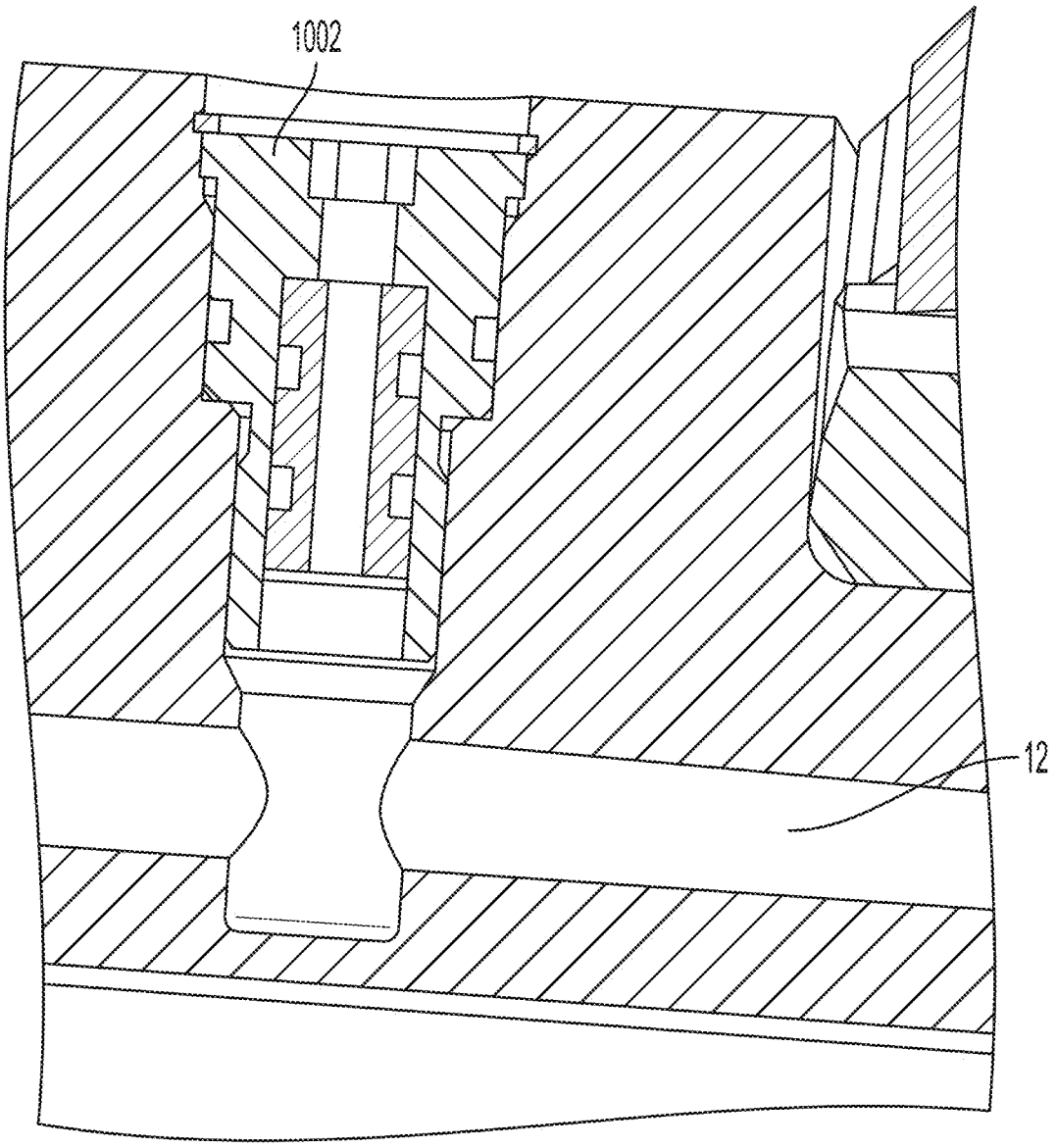
FIG. 11 is a sectional side-view of an orifice holder and an orifice according to one example of the present disclosure.

FIG. 11 is a sectional side-view of the orifice holder 1002 and the orifice 12 according to one example of the present disclosure. The orifice 12 can be positioned on the up-hole side, on the downhole side, or a combination thereof, of the pad 5, the pad pocket 204, or other suitable components of a pad actuator (e.g., the pad actuator 1000). The orifice holder 1002 can hold the orifice 12, keep the orifice 12 stationary, or otherwise couple to the orifice 12. Additionally, a manual isolation valve can be positioned in the mud line between the upstream location, such as the geostationary valve, and the mud inlet to the pistons 3.

Figure 12:
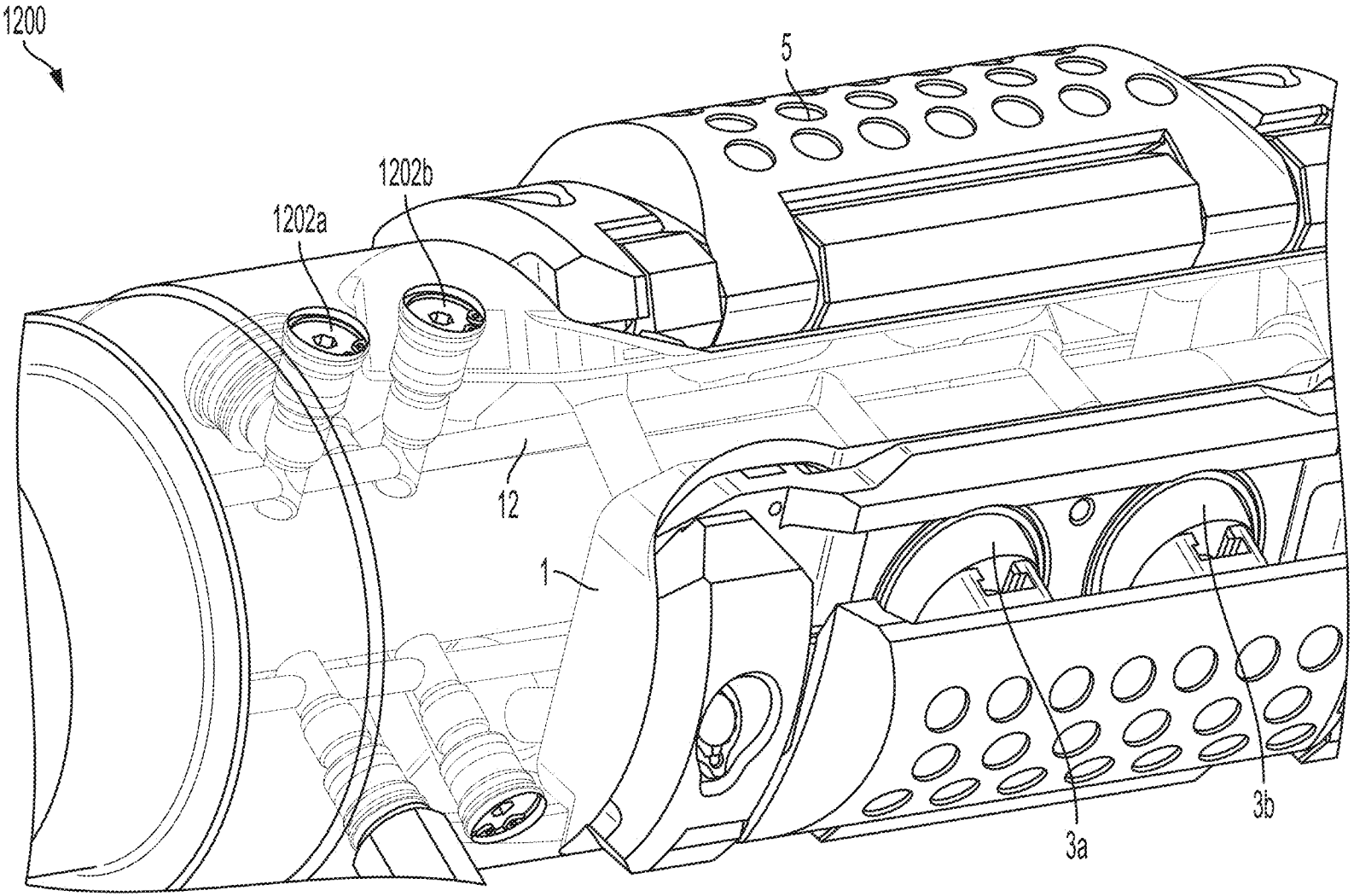
FIG. 12 is a perspective view of a pad actuator that includes a set of ports according to one example of the present disclosure.

FIG. 12 is a perspective view of a pad actuator 1200 that includes a set of ports 1202*a-b* according to one example of the present disclosure. The pad actuator 1200 can additionally include the pad 5, the pistons 3*a-b*, the orifice 12, and other suitable components. As illustrated, the pad actuator 1200 includes two ports 1202*a-b*, which can each include an orifice holder 1002, but the pad actuator 1200 can include any other suitable amount (e.g., less than two or more than two) of ports 1202*a-b*. The ports 1202*a-b* can be used to access, for example, the orifice 12 or other suitable pressurized lines with respect to the pad actuator 1200. As illustrated in the pad actuator 1200, the ports 1202*a-b* can be accessible externally from the steering collar 1. The ports 1202*a-b* can additionally intersect the mud line supplying pressurized mud to pistons 3*a-b* of the pad 5. In some examples, the ports 1202*a-b* can be similar or identical in profile. But, the ports can be manually adjusted to perform various functions.

Figure 13:
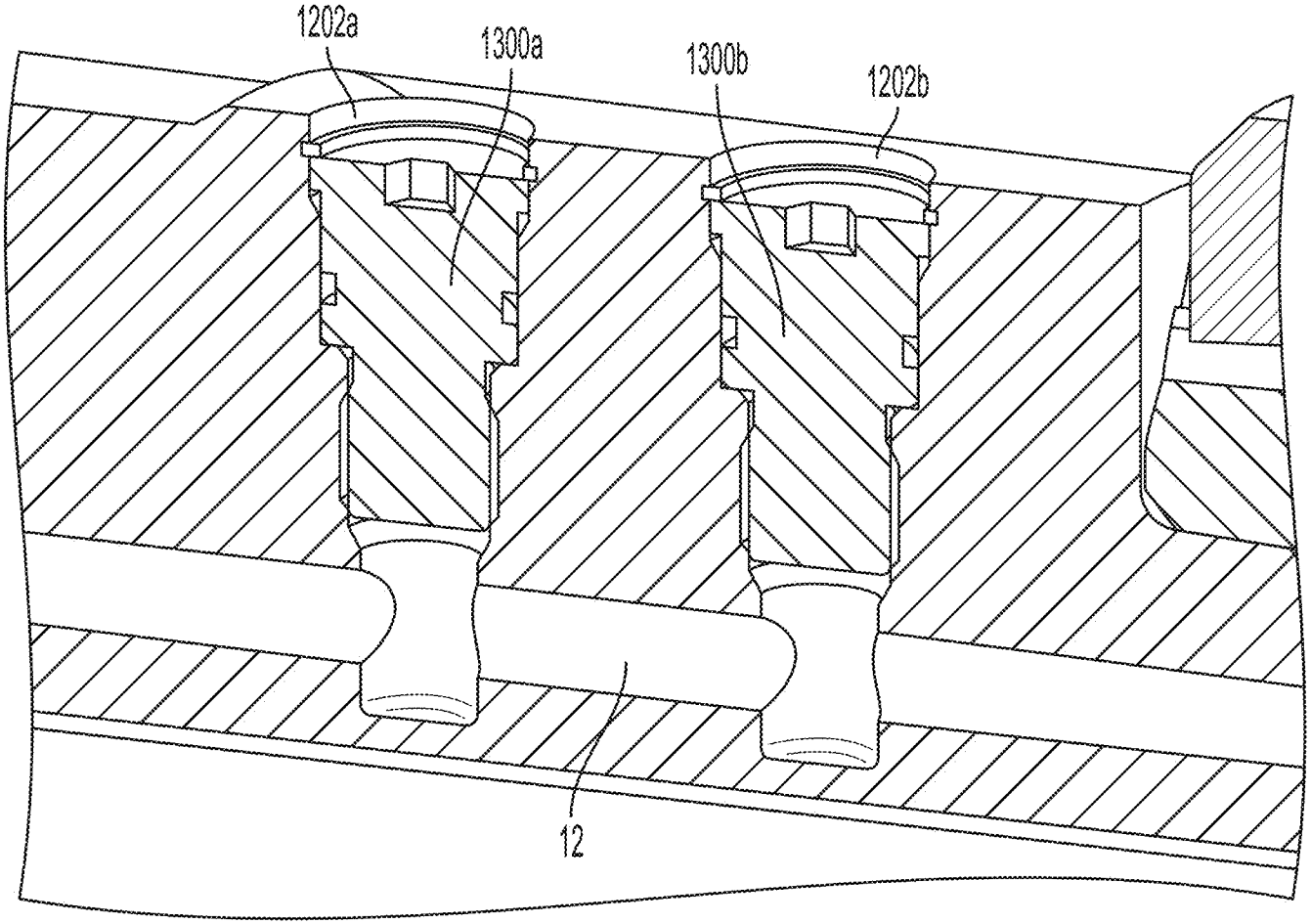
FIG. 13 is a sectional side-view of ports that include port caps according to one example of the present disclosure.

FIG. 13 is a sectional side-view of the ports 1202*a-b* that include port caps 1300*a-b* according to one example of the present disclosure. The ports 1202*a-b* may provide access to the orifice 12, but, as illustrated, the ports 1202*a-b* include corresponding port caps 1300*a-b*. The port caps 1300*a-b* may not include any orifices or pressure lines and may seal the orifice 12 from the ports 1202*a-b*.

Figure 14:
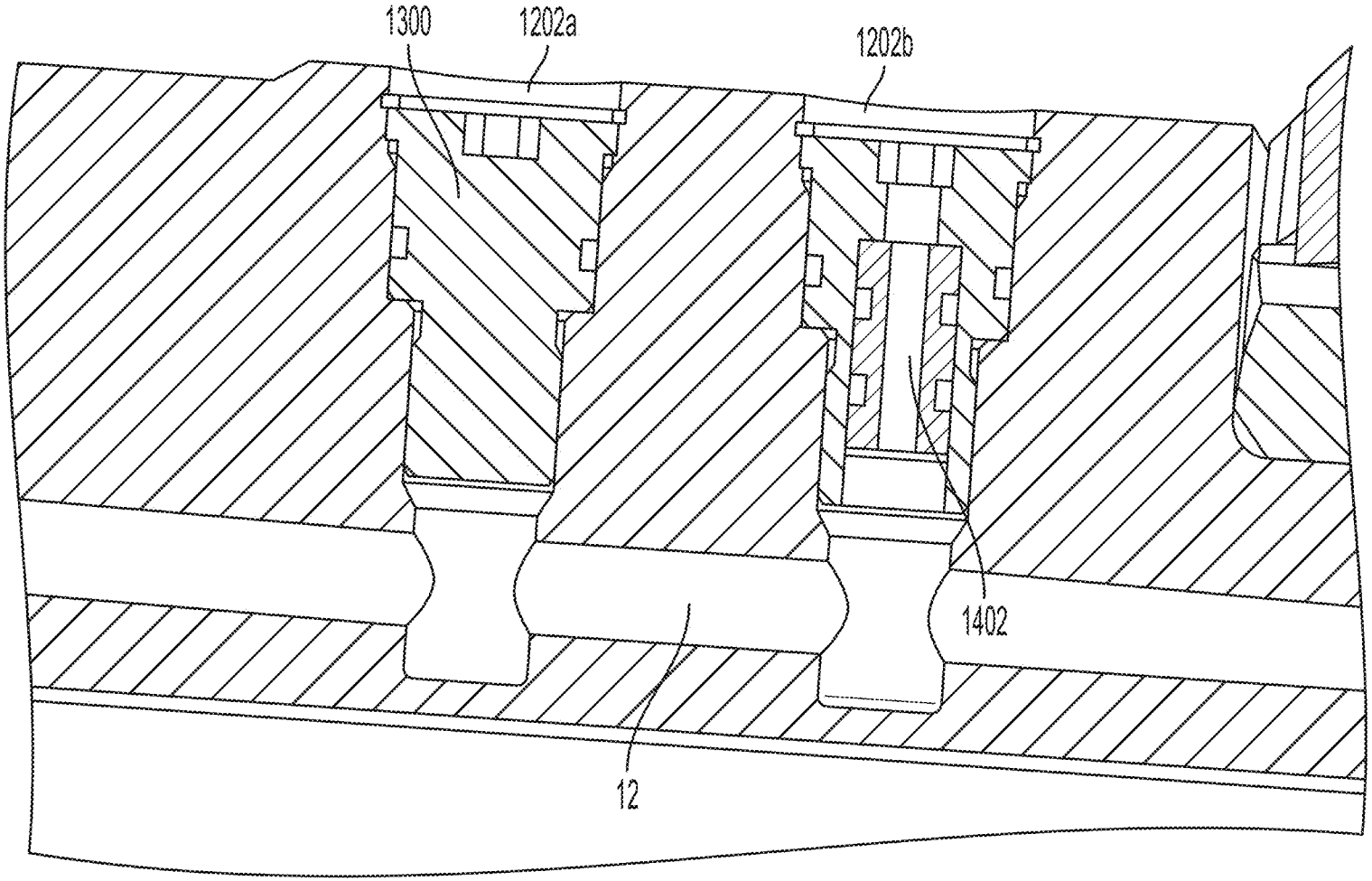
FIG. 14 is a sectional side-view of a first port that includes a port cap and a second port that includes a line to an orifice according to one example of the present disclosure.

FIG. 14 is a sectional side-view of a first port 1202*a* that includes a port cap 1300 and a second port 1202*b* that includes a line 1402 to the orifice 12 according to one example of the present disclosure. The orifice 12 may be accessible through the second port 1202*b*, for example via the line 1402, but the orifice 12 may not be accessible through the first port 1202*a* due to the port cap 1300. The port cap 1300 can be included in any suitable port 1202 of a pad actuator (e.g., the pad actuator 1200), and, in some examples, any suitable amount or combination of ports 1202 and port caps 1300 can be included in the pad actuator.

Figure 15:
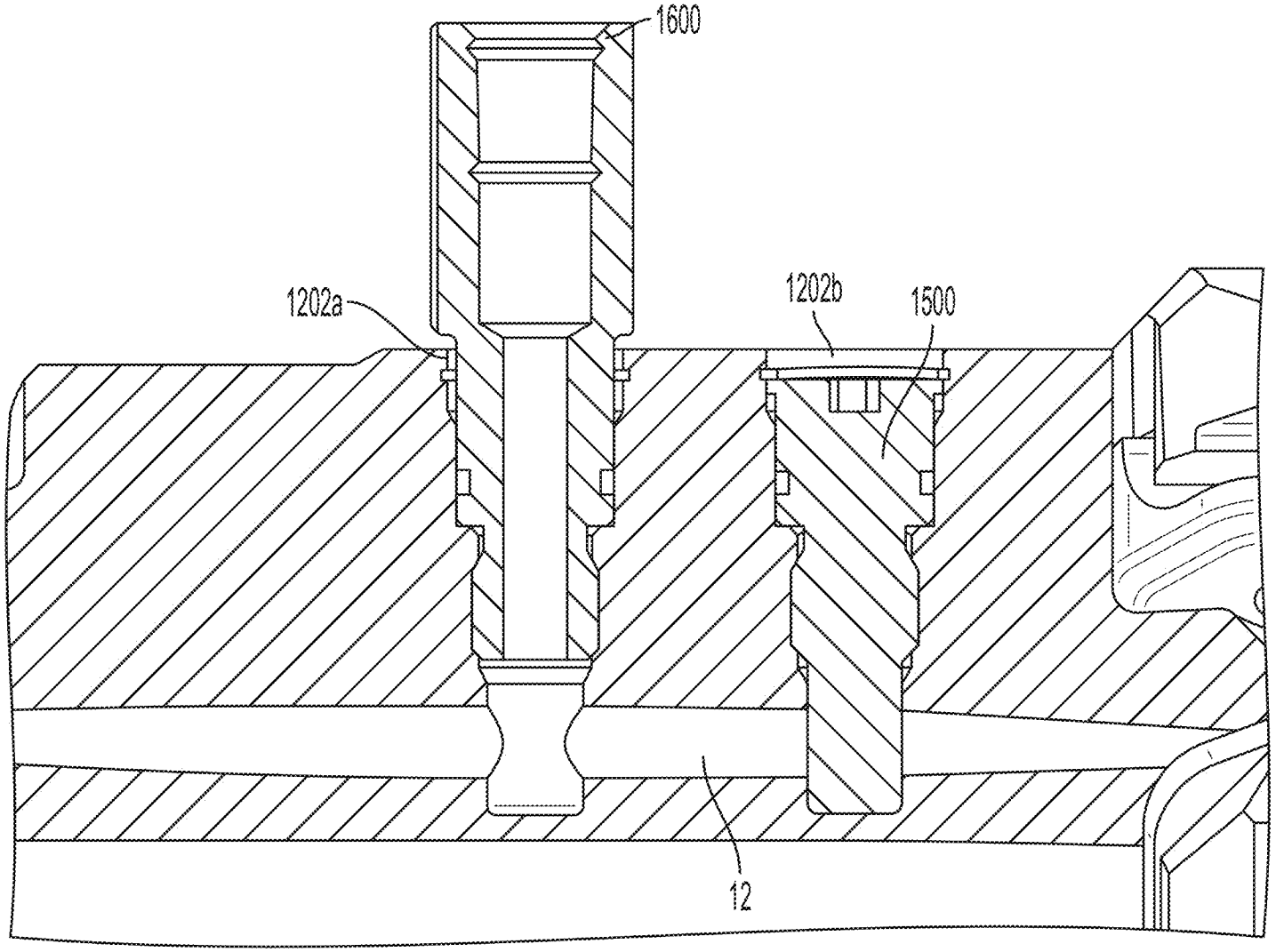
FIG. 15 is a sectional side-view of a set of ports that include an isolation valve and an adapter according to one example of the present disclosure.

FIG. 15 is a sectional side-view of a set of ports 1202*a-b* that include an isolation valve 1400 and an adapter according to one example of the present disclosure. As illustrated, the port 1202*b* is plugged by an isolation valve 1400, and the port 1202*a* includes the adapter 1600. Any suitable amounts or combinations of isolation valves 1400, adapters 1600, or other suitable components are possible. The isolation valve 1400 can isolate the pad 5 and the pistons 3 from the geostationary valve or from other suitable components of a pad actuator (e.g., the pad actuator 1200). In some examples, the port 1202*a* (which may be an upstream port with respect to the pistons 3, etc.) can be equipped with the adapter 1600 that can allow a pressure transducer to be connected to the port 1202*a*. The pressure transducer can transmit data from the port 1202*a* to a computing device or other suitable device for troubleshooting the pad actuator.

Figure 16:
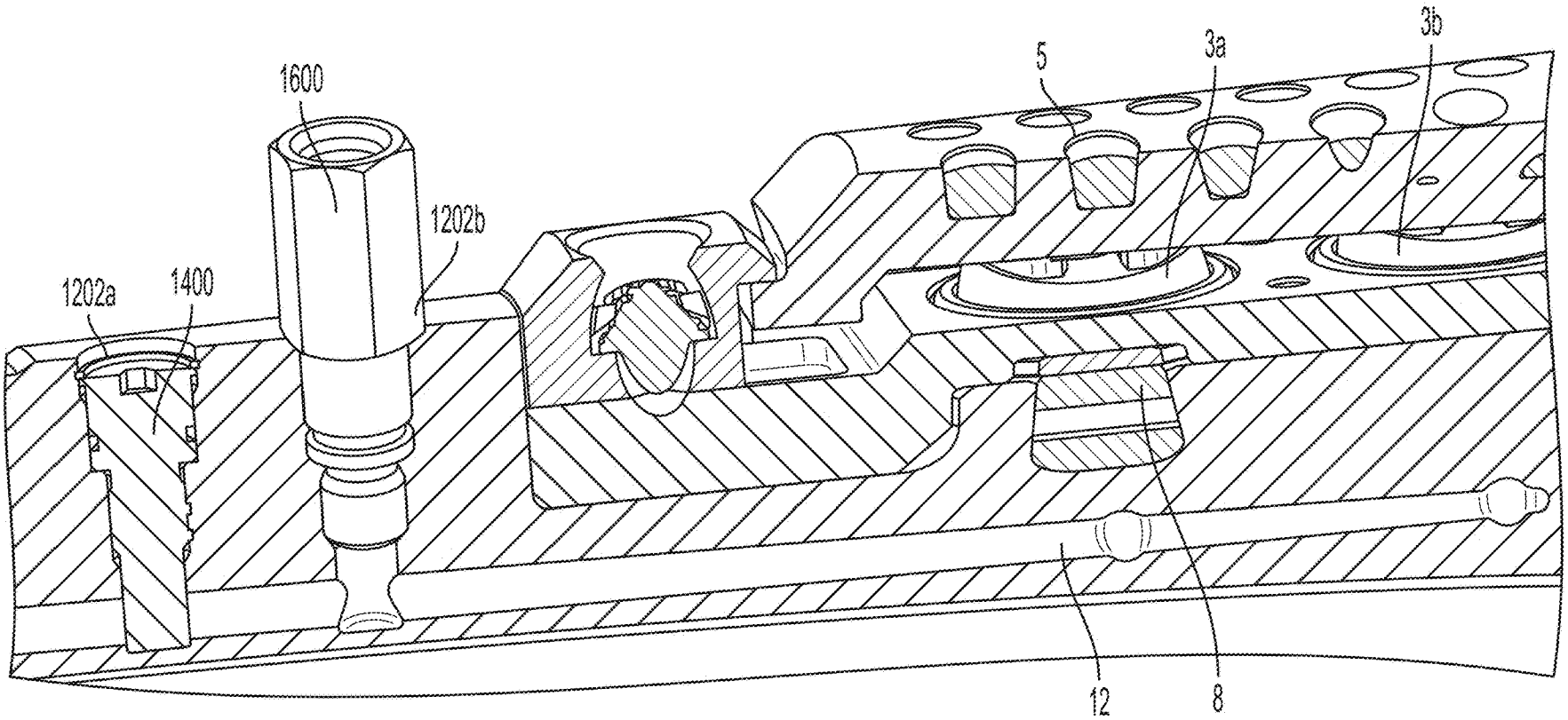
FIG. 16 is a sectional perspective view of a portion of a pad actuator that includes an isolation valve and an adapter according to one example of the present disclosure.

FIG. 16 is a sectional perspective view of a portion of a pad actuator 1500 that includes an isolation valve 1400 and an adapter 1600 according to one example of the present disclosure. The pad actuator 1500 can additionally include the pad 5, the pistons 3*a-b*, the orifice 12, the ports 1202*a-b*, and any other suitable component for the pad actuator 1500. The port 1202*a* (which may be an upstream port 1202 with respect to the pad actuator 1500, etc.) can be plugged by an isolation valve 1400. The isolation valve 1400 can isolate the pad 5 and the pistons 3*a-b* from a geostationary valve or from other suitable components of the pad actuator 1500. The port 1202*b* (which may be a downstream port 1202 with respect to the pad actuator 1500) can be equipped with an adapter 1600 that can be connected to a hydraulic system for characterizing or otherwise measuring metal-to-metal seal wear, for example, between one or more of the pistons 3*a-b* and a corresponding actuation cylinders 8.

Figure 17:
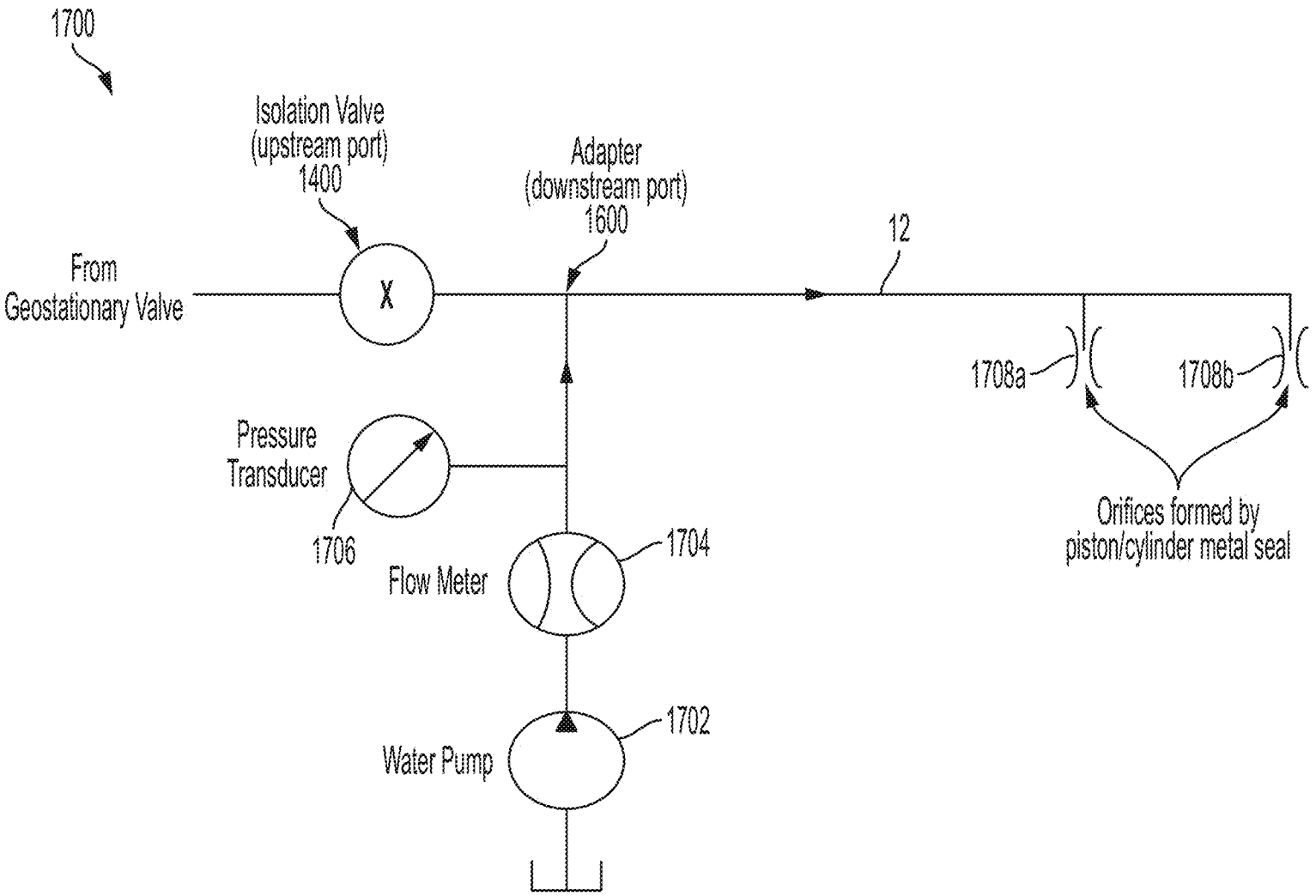
FIG. 17 is a diagram of pressure flow of a pad actuator according to one example of the present disclosure.

FIG. 17 is a diagram 1700 of pressure flow of a pad actuator (e.g., the pad actuator 1500, etc.) according to one example of the present disclosure. As illustrated in FIG. 17, output from a hydraulic pump 1702 can pass through a flow meter 1704 and a pressure transducer 1706, which can be coupled to the pad actuator 1500, for example, via the adapter 1600 or other suitable component or components. The output can enter the mud line (e.g., the orifice 12) through the downstream adapter (e.g., the adapter 1600) and exit through gaps 1708*a-b* formed by the pistons 3*a-b* and the actuation cylinders 8 of the steering pad 5. By measuring the flow rate and pressure, the metal seal performance can be characterized or otherwise measured, and hydraulics of the rotary steerable system can be adjusted. Additionally, the characterized metal seal performance can be used to determine if the wear of the metal seal exceeds a threshold wear value for replacing one or more components of the pad actuator 1500.

Figure 18:
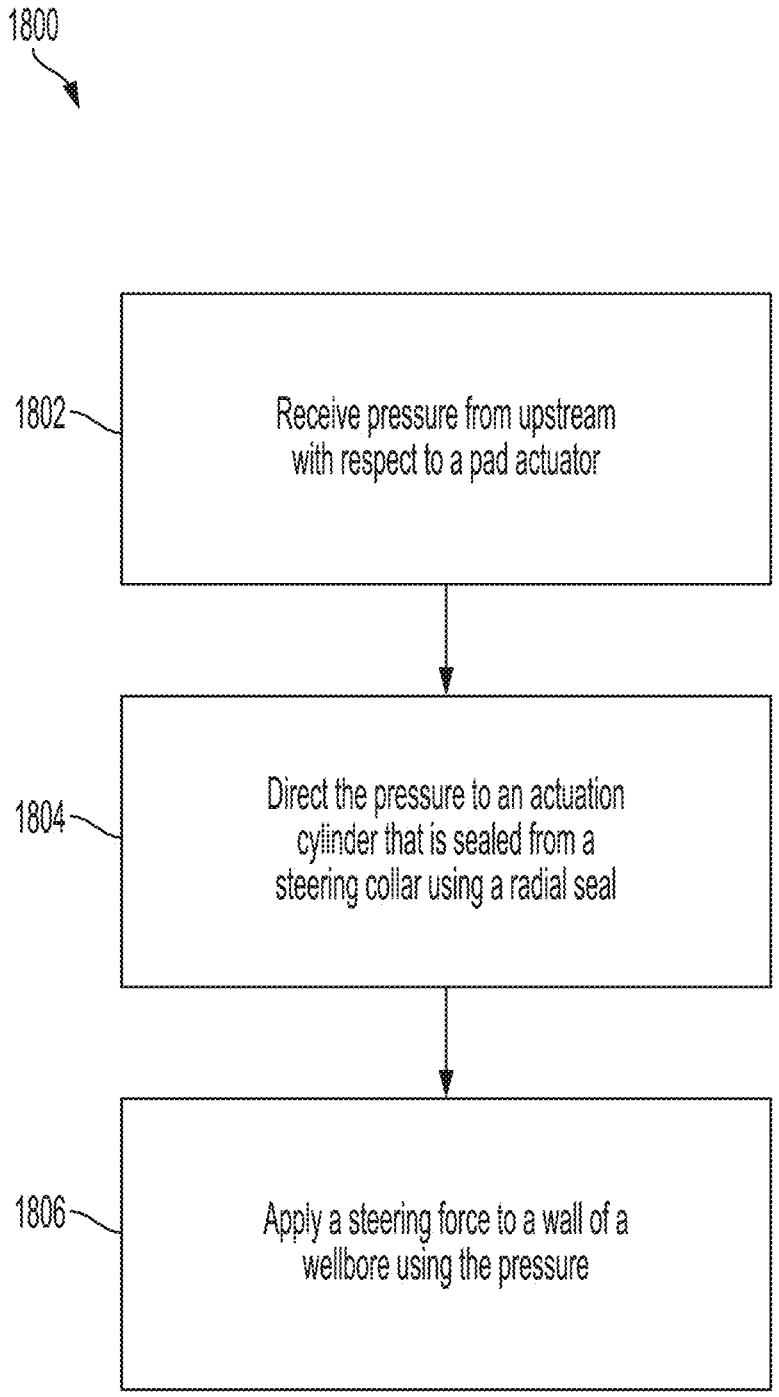
FIG. 18 is a flowchart of a process to actuate a pad actuator of a rotary steerable system according to one example of the present disclosure.

FIG. 18 is a flowchart of a process to actuate a pad actuator (e.g., the pad actuator 200) of a rotary steerable system (e.g., the rotary steerable system 109) according to one example of the present disclosure. At block 1802, the rotary steerable system 109 receives pressure upstream from the pad actuator 200. The pressure can include pressurized mud, pressurized gas, or other suitable sources of pressure that can be directed into the pad actuator 200. The pressure can originate from the surface of the wellbore 118 or from other suitable locations. The rotary steerable system 109 can receive the pressure and can direct the pressure (e.g., via the orifice 12 or other suitable components of the pad actuator 200) to other components of the pad actuator 200.

At block 1804, the rotary steerable system 109 directs the pressure to an actuation cylinder 8 that is sealed from the steering collar 1 using the radial seal 202. The pressure can be directed into one or more actuation cylinders 8 for causing the actuation cylinder 8 to open or otherwise actuate. By actuating, the actuation cylinder 8 can allow a piston 3 to rotate or otherwise displace out of the actuation cylinder 8 to apply a force on a steering pad 5. Applying the force on the steering pad 5 can cause the steering pad 5 to actuate outward.

The radial seal 202 can seal (e.g., via a pressure seal) the actuation cylinder 8 from the steering collar 1, which can provide rigidity to the rotary steerable system 109. The radial seal 202 can perform other suitable tasks. Additionally, the radial seal 202 can be combined with the face seal 11 for improving the pressure seal in the rotary steerable system 109. The pressure seal provided by the radial seal 202 can improve a performance of the rotary steerable system 109. For example, the radial seal 202 can dampen, mitigate, or otherwise eliminate high-frequency torsional oscillation (which can cause damage and excessive wear on the rotary steerable system 109) experienced by the rotary steerable system 109. Additionally, the radial seal 202 can allow pressurized mud to be directed to one or more components of the rotary steerable system 109 without causing damage or excessive wear. The radial seal 202 can perform other suitable tasks with respect to the rotary steerable system 109.

At block 1806, the rotary steerable system 109 applies a steering force on a wall of the wellbore 118. The steering pad 5 can receive pressure (e.g., the pressure received at the block 1802) from the piston 3 or other suitable component of the rotary steerable system 109. Receiving the pressure may cause the steering pad 5 to actuate, rotate, or otherwise displace outward to contact the wall of the wellbore 118. By contacting the wall of the wellbore 118, the steering pad may apply the steering force on the wall of the wellbore 118. The steering force can cause a direction of the drill bit 114, the rotary steerable system 109, any component thereof, or a combination thereof to change.

In some aspects, systems, methods, and drilling tools for a rotary steerable system with a radial seal positioned between a steering collar and an actuation cylinder are provided according to one or more of the following examples.

As used below, any reference to a series of examples is to be understood as a reference to each of those examples disjunctively (e.g., "Examples 1-4" is to be understood as "Examples 1, 2, 3, or 4").

Example 1 is a system comprising: a steering collar positionable on a drilling tool for forming a wellbore; an actuation cylinder positionable on the drilling tool abutting a steering pad for actuating the steering pad; and a radial seal positionable on the drilling tool between the steering collar and the actuation cylinder.

Example 2 is the system of example 1, further comprising a face seal positionable on the drilling tool between the steering collar and the actuation cylinder, wherein the face seal forms a pressure seal in the system by contacting the steering collar and a steering pad housing that is positionable abutting the actuation cylinder.

Example 3 is the system of example 1, wherein the radial seal forms a pressure seal within the actuation cylinder for allowing pressure to be directed into the actuation cylinder for changing a drilling direction of the system.

Example 4 is the system of example 1, further comprising: a steering pad housing, wherein the steering pad is positionable within the steering pad housing; a piston positionable within the actuation cylinder; a piston hanger positionable in the piston and adjacent at least to the steering pad for transferring pressure from the piston to the steering pad, the piston hanger including a grooved surface; an orifice positionable within the piston to allow a mud jet to be ejected from the orifice, in response to the actuation cylinder actuating, for indicating that the steering pad is actuated; a mud inlet line that is positionable to carry pressurized mud between an upstream location and the actuation cylinder; a first access port positionable on the drilling tool for allowing access to the mud inlet line; and a second access port positionable on the drilling tool for allowing access to the mud inlet line.

Example 5 is the system of any of examples 1 and 4, wherein the steering pad comprises an integrally formed T-slot that is sized to receive at least a portion of the piston hanger via the grooved surface.

Example 6 is the system of any of examples 1 and 4, wherein the steering pad comprises a T-slot sized to receive at least a portion of the piston hanger via the grooved surface, wherein the T-slot is formed separately from the steering pad, and wherein the T-slot is detachable from the steering pad.

Example 7 is the system of any of examples 1 and 4, wherein the first access port includes an adapter for receiving a pressure transducer, wherein the second access port includes an isolation valve for isolating the actuation cylinder, and wherein an amount of wear of a metal-to-metal seal between the actuation cylinder and the piston is measurable using the first access port and the second access port.

Example 8 is the system of example 1, wherein the actuation cylinder includes an orifice positionable to allow a mud jet to be ejected from the orifice, in response to the actuation cylinder actuating, for indicating that the steering pad is actuated.

Example 9 is a method comprising: receiving, at a rotary steerable system, pressure from upstream with respect to the rotary steerable system; directing, by the rotary steerable system, the pressure to an actuation cylinder of the rotary steerable system, the actuation cylinder sealed by a radial seal that is positioned between the actuation cylinder and a steering collar of the rotary steerable system; and applying, by the rotary steerable system, a steering force to a wall of a wellbore for altering a drilling direction of the rotary steerable system in the wellbore.

Example 10 is the method of example 9, wherein a face seal is positioned between the steering collar and the actuation cylinder, and wherein a combination of the radial seal and the face seal provides a pressure seal for allowing the pressure to be directed to the actuation cylinder for altering the drilling direction of the rotary steerable system.

Example 11 is the method of example 9, wherein the rotary steerable system includes: a steering pad housing, wherein the steering pad is positioned within the steering pad housing; a piston positioned within the actuation cylinder; a piston hanger positioned in the piston and adjacent at least to the steering pad for transferring pressure from the piston to the steering pad, the piston hanger including a grooved surface; an orifice positioned within the piston, wherein applying the steering force includes ejecting, in response to the actuation cylinder actuating, a mud jet from the orifice for indicating that the steering pad is actuated; a mud inlet line that is positioned from an upstream location and the actuation cylinder; a first access port positioned on the drilling tool for accessing the mud inlet line; and a second access port positioned on the drilling tool for accessing the mud inlet line.

Example 12 is the method of any of examples 9 and 11, wherein the steering pad comprises an integrally formed T-slot that is sized to receive at least a portion of the piston hanger via the grooved surface, and wherein applying the steering force includes receiving, via the integrally formed T-slot, the steering force at the steering pad.

Example 13 is the method of any of examples 9 and 11, wherein the steering pad comprises a T-slot sized to receive at least a portion of the piston hanger via the grooved surface, wherein the T-slot is formed separately from the steering pad, wherein the T-slot is detachable from the steering pad, and wherein applying the steering force includes receiving, via the integrally formed T-slot, the steering force at the steering pad.

Example 14 is the method of any of examples 9 and 11, wherein the first access port includes an adapter for receiving a pressure transducer, wherein the second access port includes an isolation valve for isolating the actuation cylinder, further comprising measuring an amount of wear of a metal-to-metal seal between the actuation cylinder and the piston using the first access port and the second access port.

Example 15 is the method of example 9, wherein applying the steering force includes ejecting, in response to the actuation cylinder actuating, a mud jet from an orifice positioned on the actuation cylinder for indicating that the steering pad is actuated.

Example 16 is a drilling tool comprising: a steering collar; a steering pad positionable on the steering collar for changing a drilling direction of the drilling tool while forming a wellbore; an actuation cylinder positionable abutting the steering pad for actuating the steering pad; and a radial seal positionable between the steering collar and the actuation cylinder.

Example 17 is the drilling tool of example 16, further comprising: a steering pad housing, wherein the steering pad is positionable within the steering pad housing; a piston positionable within the actuation cylinder; a piston hanger positionable in the piston and adjacent at least to the steering pad for transferring pressure from the piston to the steering pad, the piston hanger including a grooved surface; an orifice positionable within the piston to allow a mud jet to be ejected from the orifice, in response to the actuation cylinder actuating, for indicating that the steering pad is actuated; a mud inlet line that is positionable to carry pressurized mud between an upstream location and the actuation cylinder; a first access port positionable on the drilling tool for allowing access to the mud inlet line; and a second access port positionable on the drilling tool for allowing access to the mud inlet line.

Example 18 is the drilling tool of any of examples 16-17, wherein the steering pad comprises an integrally formed T-slot that is sized to receive at least a portion of the piston hanger via the grooved surface.

Example 19 is the drilling tool of any of examples 16-17, wherein the steering pad comprises a T-slot sized to receive at least a portion of the piston hanger via the grooved surface, wherein the T-slot is formed separately from the steering pad, and wherein the T-slot is detachable from the steering pad.

Example 20 is the drilling tool of any of examples 16-17, wherein the first access port includes an adapter for receiving a pressure transducer, wherein the second access port includes an isolation valve for isolating the actuation cylinder, and wherein an amount of wear of a metal-to-metal seal between the actuation cylinder and the piston is measurable using the first access port and the second access port.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a steering collar positionable on a drilling tool for forming a wellbore;

an actuation cylinder positionable on the drilling tool abutting a steering pad;

a piston positionable in the actuation cylinder, the piston slidably coupled to the actuation cylinder and to the steering pad for actuating the steering pad, the piston comprising an orifice to allow a mud jet to be ejected from the orifice in response to the actuation cylinder actuating, wherein a gap is defined between the piston and the actuation cylinder to facilitate flow of wellbore fluid;

a radial seal positionable in a groove on the drilling tool between the steering collar and the actuation cylinder, the radial seal stationary with respect to movement of the piston, wherein the groove is positioned in the steering collar or in the actuation cylinder;

a piston hanger positionable in the piston and adjacent at least to the steering pad for transferring pressure from the piston to the steering pad, the piston hanger including a grooved surface; and a mud inlet line that is positionable to carry pressurized mud between an upstream location and the actuation cylinder.

2. The system of claim 1, further comprising a face seal positionable on the drilling tool between the steering collar and the actuation cylinder, wherein the face seal forms a pressure seal in the system by contacting the steering collar and a steering pad housing that is positionable abutting the actuation cylinder.

3. The system of claim 1, wherein the radial seal forms a pressure seal within the actuation cylinder for allowing pressure to be directed into the actuation cylinder for changing a drilling direction of the system.

4. The system of claim 1, further comprising:

a steering pad housing, wherein the steering pad is positionable within the steering pad housing;

a first access port positionable on the drilling tool for allowing access to the mud inlet line; and a second access port positionable on the drilling tool for allowing access to the mud inlet line.

5. The system of claim 4, wherein the steering pad comprises an integrally formed T-slot that is sized to receive at least a portion of the piston hanger via the grooved surface.

6. The system of claim 4, wherein the steering pad comprises a T-slot sized to receive at least a portion of the piston hanger via the grooved surface, wherein the T-slot is formed separately from the steering pad, and wherein the T-slot is detachable from the steering pad.

7. The system of claim 4, wherein the first access port includes an adapter for receiving a pressure transducer, wherein the second access port includes an isolation valve for isolating the actuation cylinder, and wherein an amount of wear of a metal-to-metal seal between the actuation cylinder and the piston is measurable using the first access port and the second access port.

8. The system of claim 1, wherein the actuation cylinder includes an orifice positionable to allow a mud jet to be ejected from the orifice, in response to the actuation cylinder actuating, for indicating that the steering pad is actuated.

9. A method comprising:

receiving, at a rotary steerable system, pressure from upstream with respect to the rotary steerable system;

directing, by the rotary steerable system, the pressure to an actuation cylinder of the rotary steerable system, the actuation cylinder sealed by a radial seal that is positioned in a groove and between the actuation cylinder and a steering collar of the rotary steerable system, wherein the groove is positioned in the steering collar or in the actuation cylinder, the radial seal stationary with respect to movement of a piston positioned in the actuation cylinder, wherein the piston is slidably coupled to the actuation cylinder and to a steering pad of the rotary steerable system for actuating the steering pad, the piston comprising an orifice to allow a mud jet to be ejected from the orifice in response to the actuation cylinder actuating, the piston positioned in the actuation cylinder to define a gap between the piston and the actuation cylinder to facilitate flow of wellbore fluid, wherein the rotary steerable system includes:

a mud inlet line that is positioned from an upstream location and the actuation cylinder; and a piston hanger positioned in the piston and adjacent at least to the steering pad for transferring pressure from the piston to the steering pad, the piston hanger including a grooved surface; and applying, by the rotary steerable system, a steering force to a wall of a wellbore for altering a drilling direction of the rotary steerable system in the wellbore.

10. The method of claim 9, wherein a face seal is positioned between the steering collar and the actuation cylinder, and wherein a combination of the radial seal and the face seal provides a pressure seal for allowing the pressure to be directed to the actuation cylinder for altering the drilling direction of the rotary steerable system.

11. The method of claim 9, wherein the rotary steerable system further includes:

a steering pad housing, wherein the steering pad is positioned within the steering pad housing;

a first access port positioned on a drilling tool of the rotary steerable system for accessing the mud inlet line; and a second access port positioned on the drilling tool for accessing the mud inlet line.

12. The method of claim 11, wherein the steering pad comprises an integrally formed T-slot that is sized to receive at least a portion of the piston hanger via the grooved surface, and wherein applying the steering force includes receiving, via the integrally formed T-slot, the steering force at the steering pad.

13. The method of claim 11, wherein the steering pad comprises a T-slot sized to receive at least a portion of the piston hanger via the grooved surface, wherein the T-slot is formed separately from the steering pad, wherein the T-slot is detachable from the steering pad, and wherein applying the steering force includes receiving, via the integrally formed T-slot, the steering force at the steering pad.

14. The method of claim 11, wherein the first access port includes an adapter for receiving a pressure transducer, wherein the second access port includes an isolation valve for isolating the actuation cylinder, further comprising measuring an amount of wear of a metal-to-metal seal between the actuation cylinder and the piston using the first access port and the second access port.

15. The method of claim 9, wherein applying the steering force includes ejecting, in response to the actuation cylinder actuating, a mud jet from an orifice positioned on the actuation cylinder for indicating that the steering pad is actuated.

16. A drilling tool comprising:

a steering collar;

a steering pad positionable on the steering collar for changing a drilling direction of the drilling tool while forming a wellbore;

an actuation cylinder positionable abutting the steering pad;

a piston positionable in the actuation cylinder, the piston slidably coupled to the actuation cylinder and to the steering pad for actuating the steering pad, the piston comprising an orifice to allow a mud jet to be ejected from the orifice in response to the actuation cylinder actuating, wherein a gap is defined between the piston and the actuation cylinder to facilitate flow of wellbore fluid;

a radial seal positionable in a groove and between the steering collar and the actuation cylinder, the radial seal stationary with respect to movement of the piston, wherein the groove is positioned in the steering collar or in the actuation cylinder;

a piston hanger positionable in the piston and adjacent at least to the steering pad for transferring pressure from the piston to the steering pad, the piston hanger including a grooved surface; and a mud inlet line that is positionable to carry pressurized mud between an upstream location and the actuation cylinder.

17. The drilling tool of claim 16, further comprising:

a steering pad housing, wherein the steering pad is positionable within the steering pad housing;

a first access port positionable on the drilling tool for allowing access to the mud inlet line; and a second access port positionable on the drilling tool for allowing access to the mud inlet line.

18. The drilling tool of claim 17, wherein the steering pad comprises an integrally formed T-slot that is sized to receive at least a portion of the piston hanger via the grooved surface.

19. The drilling tool of claim 17, wherein the steering pad comprises a T-slot sized to receive at least a portion of the piston hanger via the grooved surface, wherein the T-slot is formed separately from the steering pad, and wherein the T-slot is detachable from the steering pad.

20. The drilling tool of claim 17, wherein the first access port includes an adapter for receiving a pressure transducer, wherein the second access port includes an isolation valve for isolating the actuation cylinder, and wherein an amount of wear of a metal-to-metal seal between the actuation cylinder and the piston is measurable using the first access port and the second access port.

* * * * *